US008302788B2

(12) United States Patent
Vargo

(10) Patent No.: US 8,302,788 B2
(45) Date of Patent: Nov. 6, 2012

(54) DEMOUNTABLE SHELVING UNIT

(75) Inventor: William R. Vargo, Lithonia, GA (US); Leroy Cameron Tuck, legal representative, Homosassa, FL (US)

(73) Assignee: Hardy Imports, Inc.

( * ) Notice: Subject to any disclaimer, the term of this patent is extended or adjusted under 35 U.S.C. 154(b) by 0 days.

(21) Appl. No.: 12/356,209

(22) Filed: Jan. 20, 2009

(65) Prior Publication Data

US 2010/0181274 A1 Jul. 22, 2010

(51) Int. Cl.
*A47B 47/00* (2006.01)

(52) U.S. Cl. ..... 211/186; 211/191; 211/189

(58) Field of Classification Search ..... 211/191, 211/192, 206, 189, 190, 195, 186, 187, 207, 211/106, 107, 26; 108/147.17, 147.15, 147.12, 108/188, 187; 312/265.4
See application file for complete search history.

(56) References Cited

U.S. PATENT DOCUMENTS

| | | | | | |
|---|---|---|---|---|---|
| RE24,535 | E | * | 9/1958 | Franks | 211/191 |
| 3,199,471 | A | * | 8/1965 | Orsi | 108/187 |
| 3,237,779 | A | * | 3/1966 | Eger | 211/191 |
| 3,266,635 | A | * | 8/1966 | McConnell | 211/191 |
| 3,358,848 | A | * | 12/1967 | Johnsson | 211/190 |
| 3,386,591 | A | * | 6/1968 | Cassel | 211/183 |
| 3,625,372 | A | * | 12/1971 | MacKenzie | 211/191 |
| 3,664,513 | A | * | 5/1972 | Atwater | 211/134 |
| 3,685,665 | A | * | 8/1972 | Atwater | 211/191 |
| 3,905,483 | A | * | 9/1975 | Patrick | 211/190 |
| 4,285,436 | A | * | 8/1981 | Konstant et al. | 211/192 |
| 4,423,817 | A | * | 1/1984 | Monjo-Rufi | 211/187 |
| 4,648,517 | A | * | 3/1987 | Schafer | 211/183 |
| 4,708,252 | A | * | 11/1987 | Azzi | 211/192 |
| 5,012,938 | A | * | 5/1991 | King | 211/191 |
| 5,443,167 | A | * | 8/1995 | Menaged et al. | 211/106.01 |
| 5,806,820 | A | * | 9/1998 | Simon | 248/243 |
| 7,464,509 | B1 | * | 12/2008 | Brown | 52/426 |

* cited by examiner

*Primary Examiner* — Darnell Jayne
*Assistant Examiner* — Stanton L Krycinski
(74) *Attorney, Agent, or Firm* — Michael J. Mehrman; Mehrman Law Office

(57) ABSTRACT

A demountable shelving unit with welded crossbar supports, open-channel upright supports, and channel support features. The welded crossbar supports and diagonal supports are slidably received within open-channel upright supports. Upper and lower crossbar supports include upright insertion blocks that are captured within the upright supports and horizontal connectors that extend through slots in the upright supports to connect two upright supports together to form an end unit. Shelf units are connected between two end units to create an assembled shelf. For a typical shelving unit, only eight bolts are needed to assemble each end unit and the shelf units attach to the end units with rivet-type quick disconnect fasteners that fit within teardrop shaped sockets in the upright supports. This results in a demountable shelf that can be assembled quickly and easily with only sixteen bolts per shelving unit.

18 Claims, 22 Drawing Sheets

DETAIL H (WITHOUT UPRIGHT SUPPORT)

DETAIL H (WITH UPRIGHT SUPPORT)

DETAIL H (WITH UPRIGHT SUPPORT AND BOLT)

DEMOUNTABLE SHELVING UNIT

TECHNICAL FIELD

The present invention relates to the field of demountable shelving units or storage racks and, more particularly, to a demountable shelving unit with welded crossbar supports, open-channel upright supports, and channel support features.

BACKGROUND OF THE INVENTION

Demountable shelving units or storage racks are used to store goods in a wide range of applications, such as warehouses, retail stores, hardware stores, nurseries, produce growers, and the like. Many large wholesale-style chain stores, such as The Home Depot®, Lowes® and COSCO® use a large number of these racks both inside and outside the stores. The demand for demountable shelving units has therefore increased in recent years with the increasing popularity of the wholesale-style chain stores. The shelving units for these stores are designed to carry thousands of pounds and, as a result, are quite heavy. Manufacturing, transporting and assembling the shelving units has therefore developed into in significant business.

In general, there is a continuing need for heavy and light duty shelving units that are easy to assemble quickly without assembly errors. For example, in a conventional shelving unit assembled with a large number of bolts, a common assembly error occurs when the shelves are attached to the upright supports at offset bolt locations resulting in non-square shelf attachment. This is a relatively easy mistake to make because the available bolt holes on the upright supports are close together, making it relatively easy to install a shelf with a bolt hole offset on one or more of the uprights. Non-square shelf attachment weakens the shelving unit and applies undesirable torque forces to the shelf, which can cause a shelf or shelving unit to twist, bend or buckle. In some case, a large rack of shelving units can be installed with multiple bolt location offsets extending across multiple shelf rows and columns, making correction of the assembly errors a tedious and time consuming process.

In addition, the extent to which the shelving units disassemble can present a tradeoff between ease of assembly and convenience for transportation, typically in a container carried by ship or truck. That is, a fully disassembled shelving unit can be stacked most compactly for transport, while maximizing the amount of assembly required once the shelving unit has arrived at its final destination. Shipping the shelving unit with partially assembled structures typically makes the unit assembly easier and faster, but reduces the number of shelving units that can be packed into a shipping container. There is, therefore, a continuing need for shelving units with desirable characteristics for both shipping and on-site assembly at the unit's final destination.

SUMMARY OF THE INVENTION

The present invention meets the needs described above in a demountable shelving unit with welded crossbar supports, open-channel upright supports, and channel support features. Welding the crossbar supports into the desired assembled configuration eliminates the possibility of assembling these components incorrectly. The welded crossbar supports are planar sections, which makes them stack well for transportation. In addition, the welded crossbar supports slide into the open-channel upright supports, making the shelving unit easy to assemble quickly without assembly errors and with far fewer bolts than conventional shelving units. In the preferred configuration, the demountable shelving unit (excluding fasteners for the shelf decking, if desired) can each be assembled with only sixteen bolts, which includes eight bolts for each end unit. The shelving units also includes a variety of channel support features that add strength to the assembled shelf while permitting easy and fast assembly and disassembly of the units.

Generally described, the invention may be implemented as a demountable shelving unit that includes first and second planar, vertically oriented end units and a plurality of planar, horizontally oriented shelf units removably connected between and orthogonal to the end units. Each end unit includes front and rear open-channel upright supports and upper and lower crossbars slidably received within the upright supports. Each open-channel upright support has an undivided outer face and an opposing divided inner face defining a slot. Each cross bar includes front and rear upright insertion blocks welded to a horizontal connector and, for each end unit, the front upright insertion block is slidably captured within the front upright support, the rear upright insertion block is slidably captured within the rear upright support, and the horizontal connector extends through the slots of the front and rear uprights supports.

More specifically for a particular embodiment, for each end unit and for each upright support, the upright support defines a top end and a bottom end. For each upright insertion block of each lower crossbar, the upright insertion block is terminated by a based plate comprising a plurality of support tabs extending from the base plate; and the bottom end of the upright support is positioned between the upright insertion block and the support tabs extending from the base plate. Similarly, for each base plate, a threaded fastener extends through the upright support and through the upright insertion block above the base plate securing the upright support to the upright insertion block with the bottom end of the upright support is positioned between the upright insertion block and the support tabs extending from the base plate. Each base plate may be welded to its associated upright insertion block or held in place by additional support tabs extending from the base plate.

In addition, each end unit also typically includes at least one diagonal support extending diagonally between the front and rear upright supports and through the slots of the front and rear upright supports. The diagonal support includes a front end face angled to be aligned with the outer face of the front upright support and a rear end face angled to be aligned with the outer face of the rear upright support. The shelving unit further includes a first threaded fastener extending through the outer face of the front upright support and through the front end face of the diagonal support securing the diagonal support to the front upright support. A second threaded fastener extends through the outer face of the rear upright support and through the rear end face of the diagonal support securing the diagonal support to the rear upright support.

Continuing in greater detail, for each upright support, the slot is defined by first and second flanges extending along the slot, the diagonal support comprises a first flange clip engaging the first flange to secure the first flange between the diagonal support and the first flange clip, and the diagonal support comprises a second flange clip engaging the second flange to secure the second flange between the diagonal support and the second flange clip. In addition, for each upright support and each upright insertion block of each upper crossbar, the upright support includes a fastener hole, the upright insertion block includes a fastener hole corresponding to the fastener hole of the upright support, and a threaded fastener extends through the fastener hole of the upright support and through the fastener hole of the upright insertion block to secure the upper crossbar to the upright support.

To strengthen the shelving unit, the upright support defines a top end and a bottom end and the upright insertion block of the lower crossbar is terminated by a based plate that includes a system of support tabs extending from the base plate. The bottom end of the upright support is positioned between the upright insertion block and the support tabs extending from the base plate. In addition, a threaded fastener extends through the upright support and through the upright insertion block above the base plate securing the upright support to the upright insertion block with the bottom end of the upright support is positioned between the upright insertion block and the support tabs extending from the base plate.

As another strengthening feature, the slot in the upright support is defined by flanges extending along the slot and the diagonal support includes flange clips that engage flanges to secure the flanges to the diagonal support. In addition, the end face the diagonal support includes a fastener hole corresponding to a fastener hole of the upright support, and a threaded fastener extends through the fastener hole of the upright support and through the fastener hole of the end face of the diagonal support to secure the diagonal support to the upright support.

It should be appreciated that in a particular embodiment, each end unit may consist essentially of a front upright support, a rear upright support, an upper crossbar, a lower cross bar, and at least one diagonal support. Each end unit may be configured to be assembled with a plurality of threaded fasteners, and the end unit may include an upper diagonal support and a lower diagonal support. Even more particularly, each end unit may be configured to be assembled no more than eight threaded fasteners. In addition, each upright support includes a series of tear-drop shaped sockets and each horizontal shelf unit includes a number of rivet-type connectors configured for quick disconnect engagement with the tear-drop shaped sockets.

The specific techniques and structures for implementing particular embodiments of the demountable shelving unit system, and thereby accomplishing the advantages described above, will become apparent from the following detailed description of the embodiments and the appended drawings and claims.

DETAILED DESCRIPTION OF THE EMBODIMENTS

Figure 1:
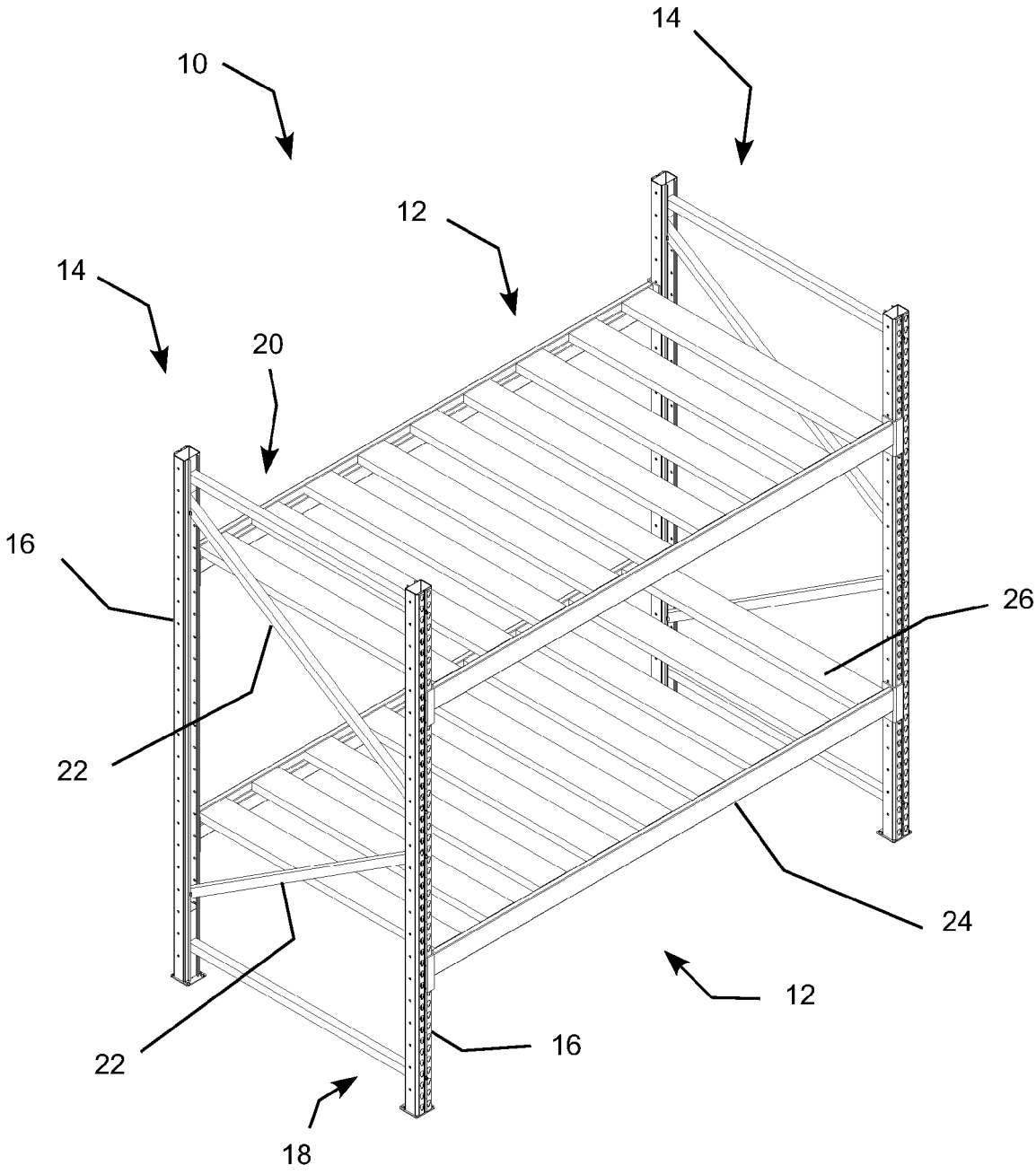
FIG. 1 is a perspective view of the demountable shelving unit in its assembled configuration.

The present invention provides significant improvements in demountable shelving units by providing a demountable shelving unit with welded crossbar supports, open-channel upright supports, and channel support features. The welded crossbar supports and diagonal supports are slidably received within open-channel upright supports. Upper and lower crossbar supports include upright insertion blocks that are captured within the upright supports and horizontal connectors that extend through slots in the upright supports to connect two upright supports together to form an end unit. Shelf units are connected between two end units to create an assembled shelf. For a typical shelving unit, only eight bolts are needed to assemble each end unit and the shelf units attach to the end units with rivet-type quick disconnect fasteners that fit within teardrop shaped sockets in the upright supports. This results in a demountable shelf that can be assembled quickly and easily with only sixteen bolts per shelving unit.

The demountable shelving unit includes several features to add strength to the unit in view of the open-channel upright supports. These features secure the open-channel upright support to prevent the upright support from twisting or buckling through uncontrolled widening of the slot in the upright support. A system of support tabs including cornet braces and side braces in the base plates of the lower crossbar forms a first strengthening feature. The upright support fits over the upright insertion block of the lower cross bar and rests on the base plate with the bottom end of the upright support captured between the support tabs and the upright support. A bolt holds the upright support to the insertion block in this position to securely support the bottom end of the upright support. In addition, the diagonal support includes flange clips that engage flanges defining the slot along the upright support to hold the slot together at one or more locations along the upright support. The diagonal supports and the upper crossbar are also bolted to the upright supports to add strength and hold the end units together. The features described above result in a demountable shelving unit that is sufficiently strong for its intended purpose, assembled with a minimal number of bolts, and demountable into planar components that stack well for storage and transport.

The demountable shelving unit may be implemented in various sizes and with various materials providing different loading capacities and amounts of shelf space. The embodiment shown in shown in FIGS. 1-25 is eight feet high and shown substantially to scale. Although the end units in the shelving unit shown in the figures have two crossbars and two diagonal supports, an additional crossbar may be added between the diagonal supports to increase the strength of the unit. In addition, the single-bar diagonal supports may be replaced by "X" shaped dual-bar diagonal supports or a revered "K" configuration to further increase the loading capacity of the unit. As additional strengthening features, the diagonal supports may include upright insertion blocks similar to the crossbars captured within the upright supports, the crossbars may include flange clips as similar to those illustrated for the diagonal supports, the interior space of the upright supports between insertion blocks may be filled with column stiffeners, and the unit may include additional slot braces that attach to the flanges and span the slot of the upright support.

Typical sizes of the demountable shelving unit (in inches) are 192H×96W×42D (sixteen foot tall unit) and 96H×48W×42D (eight foot tall unit), although other sizes may be provided as desired. The eight foot tall demountable shelving unit shown in figures can be increased to sixteen feet tall with the inclusion of a central horizontal support and another iteration of diagonal supports in each end unit. The end unit of the eight foot tall shelving unit can typically be assembled with eight bolts, while the end unit of the sixteen foot tall shelving unit can typically be assembled with fourteen bolts. If reverse "K" end units are used, the eight foot tall shelving unit can typically be assembled with ten bolts, while the end unit of the sixteen foot tall shelving unit can typically be assembled with eighteen bolts. If dual-bar diagonal supports are used, the eight foot tall shelving unit can typically be assembled with twelve bolts, while the end unit of the sixteen foot tall shelving unit can typically be assembled with twenty two bolts. If two bolts are used for each connection to add further strength, the number of bolts required will be doubled.

In addition, different gauges of steel can be used for different components. The components of the demountable shelving unit are typically manufactured from 14 or 12 gauge steel, although other materials may be use as desired. In heavy duty shelving units, the upright supports can be manufactured from 12 gauge steel, while the crossbars and diagonal supports can be manufactured from 14 gauge steel. For lighter duty shelving units, the upright supports may be manufactured from 16 or 18 gauge steel, and 18 or 20 gauge steel may be used for the diagonal supports. Other gauges of steel may be selected as desired.

Including dual-bar diagonal supports, upright insertion blocks on the diagonal supports, flange tabs on the crossbars, column stiffeners, and additional slot braces can be used to increase the load carrying capacity of the units. The demountable shelving unit manufactured from 14 gauge steel having dimensions of 192H×96W×42D typically exhibits a load carrying capacity of about 12,000 lbs. With additional crossbars, reverse "K" diagonal supports and column stiffeners the load carrying capacity can typically be increased to about 16,000 lbs. A similar unit manufactured with 12 gauge upright supports and 14 gauge crossbars and diagonal supports typically exhibits a load carrying capacity of about 30,000 lbs. With additional crossbars, reverse "K" diagonal supports and column stiffeners, the load carrying capacity can typically be increased to about 50,000 lbs. The bolts typically range from 5/16 to ½ inch, and from grade 5 to 8, depending on the dimensions and load carrying capacity of the shelving unit. Component, material, decking and fastener selection are matters of design choice that can be adjusted as desired for different applications.

Figure 2:
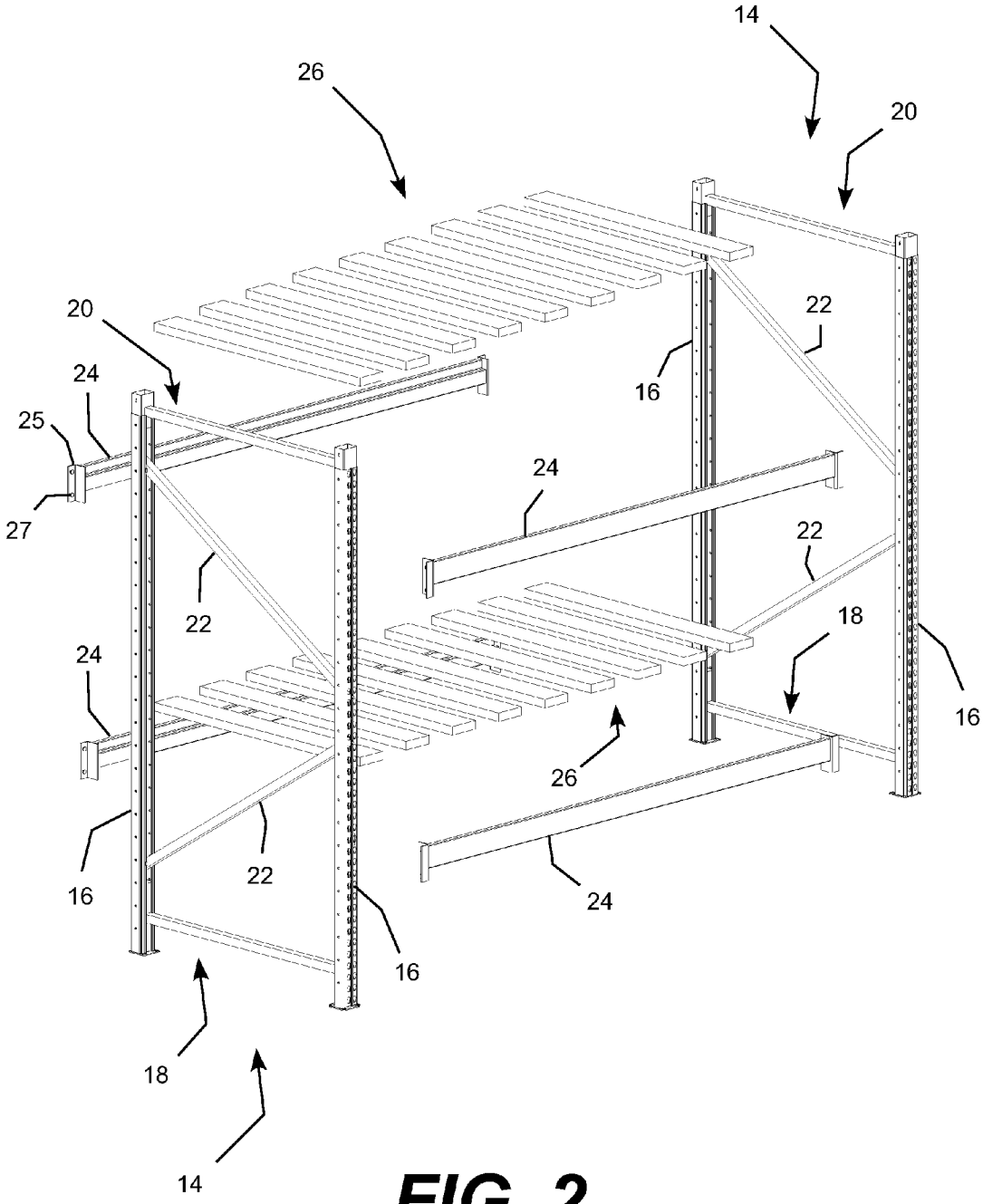
FIG. 2 is an exploded perspective view of the demountable shelving unit.

Referring to figures, FIG. 1 shows an assembled view and FIG. 2 shows an exploded view of an illustrative shelving unit 10. In general, the shelving unit is formed from multiple instances of identical parts, such as upright supports and crossbars, which will be identified in singular and in plural with a single element numeral for descriptive convenience and to avoid cluttering the figures. The shelving unit includes a number of horizontally oriented shelf units 12 connected between two vertically oriented end units 14. Although the shelf units and end units have a thickness, they are referred to as "planar" in that they do not include substantial components extending transverse to the major dimensions of the units. That is, "planar" means that when the shelving unit is disassembled, the end units and shelf units are sufficiently planar to lie substantially flat for stacking purposes, although the components obviously must have some thickness to function for their intended purpose. The shelf units 12 are also referred to a "horizontally oriented" and the end units 14 are referred to as "vertically oriented" in that they can be assembled to form a substantially square and erect shelving unit. That is, when the shelving unit is assembled as intended, the shelf units are sufficiently "horizontal" and the end units are sufficient "vertical" to form a substantially square and erect shelving unit, although it will be understood that the components may not be precisely vertical and horizontal in practice.

The end unit 14 is formed from a pair of open-channel upright supports 16, a lower crossbar 18, an upper crossbar 20, and one or more diagonal supports 22. The lower crossbar 18, upper crossbar 20, and diagonal support 22 are received within and extend between two upright supports to form an assembled end unit. The shelf unit 12 includes a pair of horizontal shelf beams 24 that extend between and connect to a pair of opposing end units 14. A number of horizontal shelf planks 26 that extend between the shelf beams to for the shelf unit. Of course, the shelf planks can be replaced with a solid sheet, wire decking, or any other suitable shelf material. The diagonal supports 22 shown here is a single-bar diagonal support without upright insertion blocks, but may be replaced by a single-bar diagonal support with upright insertion blocks, a dual-bar (X-shaped) diagonal support without upright insertion blocks, or a dual-bar diagonal support with upright insertion blocks, as desired.

The upright supports 16 include a repeating pattern of teardrop sockets (see FIGS. 18-19) for receiving rivet-type quick disconnect fasteners for quick and easy attachment of the shelf units 12 to the upright supports. Accordingly, the shelf beam 24 includes a pair of end connectors 25 with rivet-type connectors 27 that are received within the teardrop sockets of the upright supports 16 to connect the shelf beams to the end units 14 without the use of separate fasteners. The spacing of the sockets may be altered as a matter of design choice. The rivet-type quick disconnect fasteners reduce the number of bolts required to assemble the shelving unit. In addition, the shelf planks 26 may be bolted or clipped to the shelf beams 24 or, if desired, they may rest on top of the shelf beams without separate fasteners to further reduce the number of separate fasteners, typically bolts, required to assemble the shelving unit. It should be noted that the term bolt is used to refer to a non-threaded pin or threaded fastener that is separate from the structure to be fastened, which may or may not have a point on the end, and therefore covers fasteners typically referred to as pins and screws as well as typical non-pointed, threaded bolts.

Figure 3:
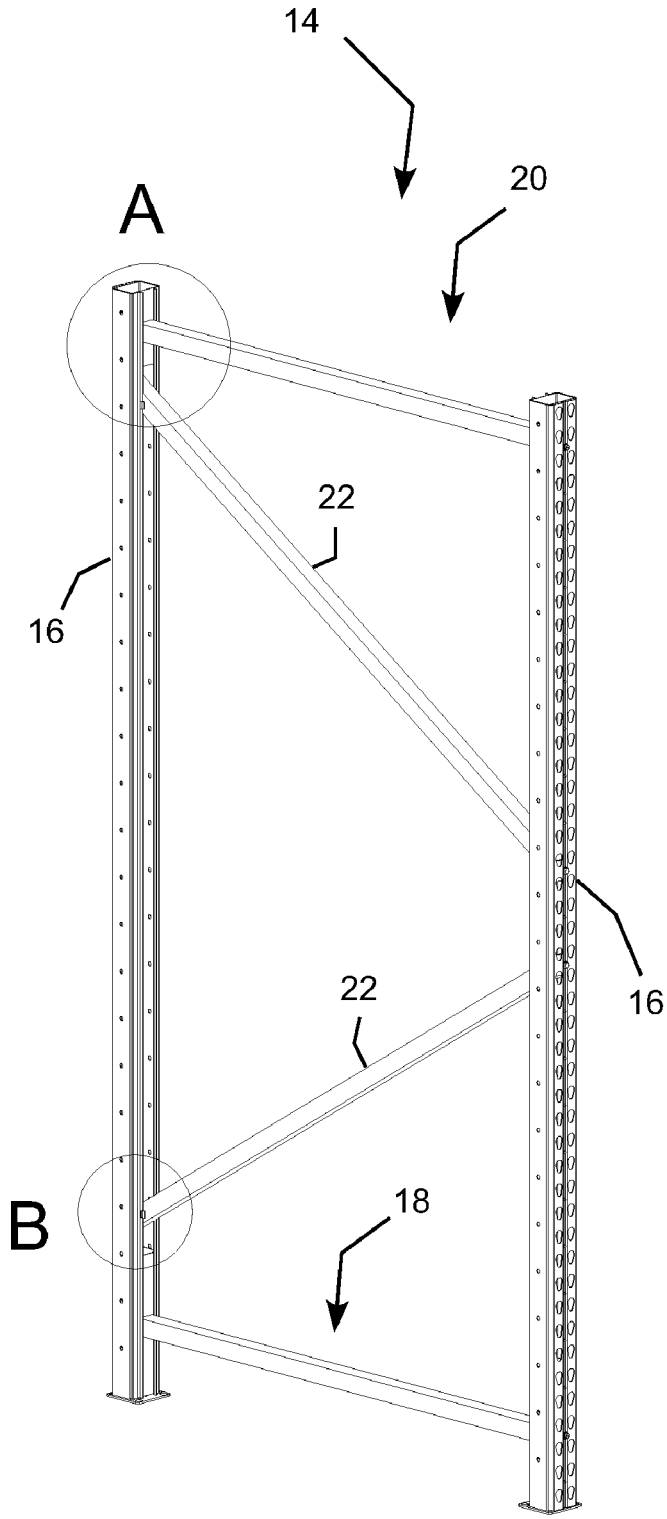
FIG. 3 is a perspective view of an end unit for the demountable shelving unit.
Figure 4:
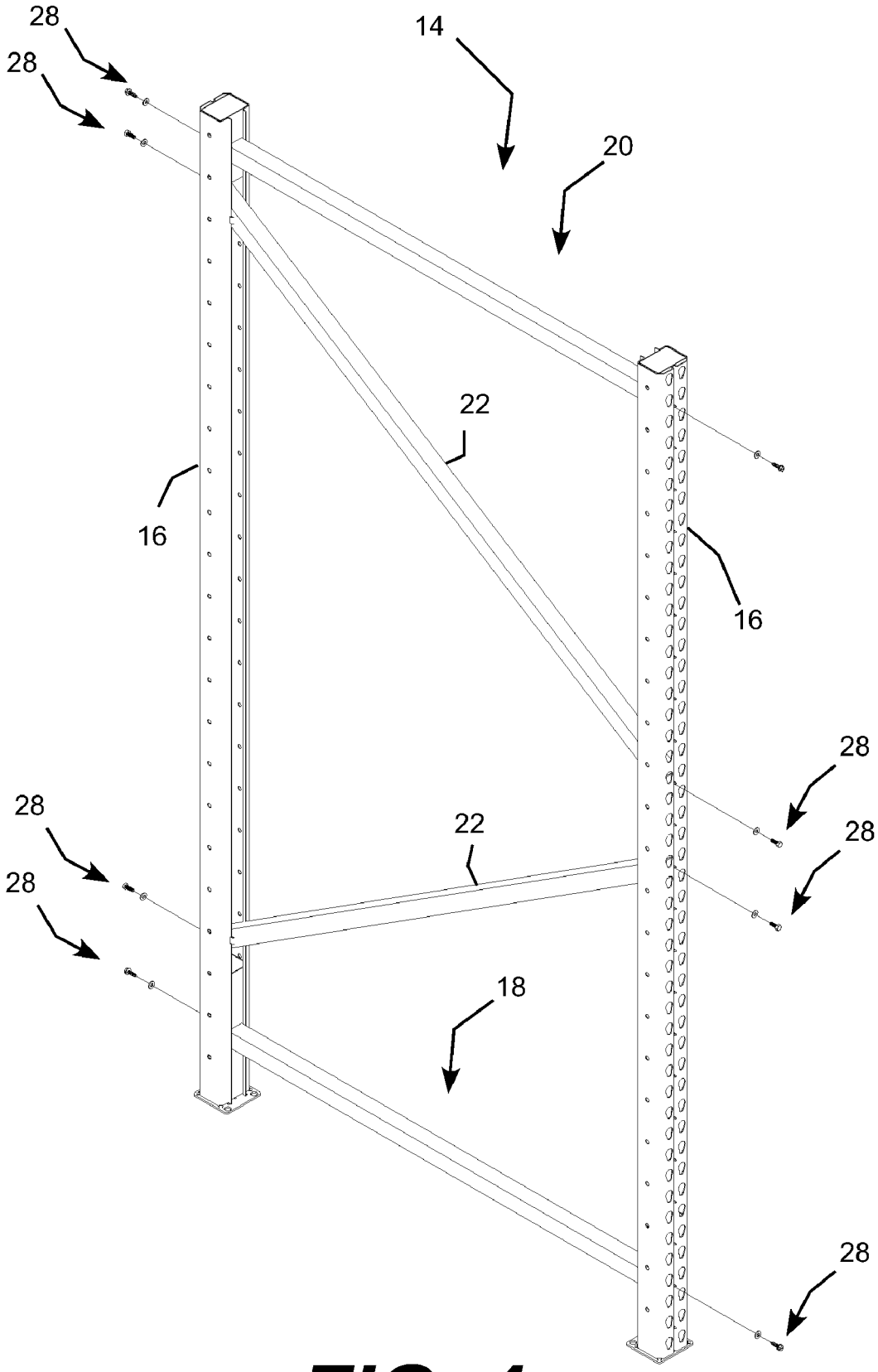
FIG. 4 is a partially exploded perspective view of the end unit for the demountable shelving unit.
Figure 5:
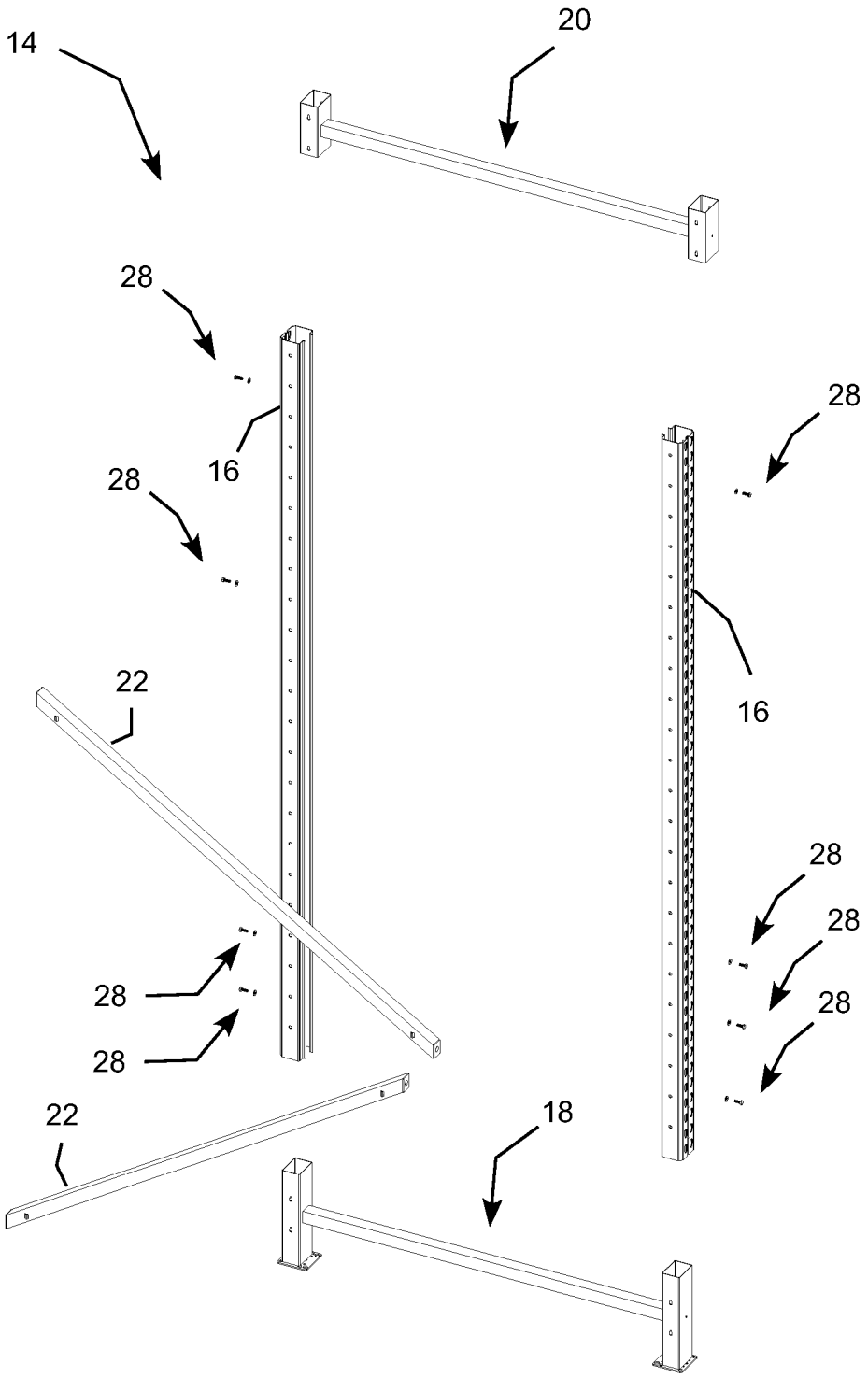
FIG. 5 is an exploded perspective view of the end unit for the demountable shelving unit.
Figure 8:
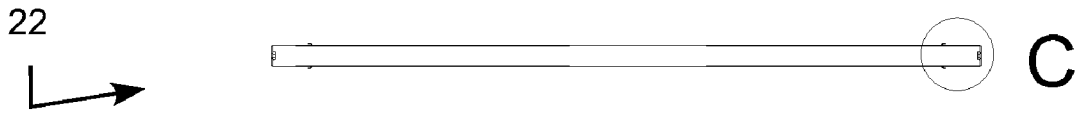
FIG. 8 is a side view of the diagonal support of the demountable shelving unit.

FIG. 3 shows the end unit 14 assembled and indicates the end detail shown in FIG. 5 and the diagonal support connection detail shown in FIG. 8, while FIG. 4 shows and exploded view of the end unit. The typical end unit includes two upright supports 16 connected together by a lower crossbar 18, an upper crossbar 20, and two diagonal supports 22. As shown in FIG. 4, two bolts 28 secure each of these components to the upright support. Thus, this particular version of the end unit 14 is assembled with eight bolts 28, two bolts to secure the lower crossbar 18 to the pair of upright supports 16, two bolts to secure the upper crossbar 20 to the pair of upright supports, two bolts to secure the first diagonal support 22 to the pair of upright supports, and two bolts to secure the second diagonal support to the pair of upright supports. The lower crossbar 18 includes base plates making this crossbar suitable for connection to the bottom end of the upright support. The upper crossbar 20 of this configuration of the end unit, on the other hand, does not include base plates and can therefore slide within the upright supports for location at different positions along the upright supports, which also permits multiple upper crossbars to be located along the upright supports if desired. Of course, the upper crossbar could include base plates if desired, in which case they will be configured for attachment at the upper ends of the upright supports. Note that the upper and lower crossbars have upright insertion blocks that are captured within the upright supports, while the diagonal crossbars do not have similar insertion blocks. Nevertheless, the diagonal supports could be configured with upright insertion blocks, if desired. It should also be appreciated that additional crossbars and/or diagonal supports could be added for additional strength if desired. It should also be appreciated, however, that the preferred end unit configuration shown in FIGS. 4 and 5 is suitable for most shelving units up to about eight feet tall with the advantage of assembly with only four connecting elements (i.e., two crossbars and two diagonal supports) and eight bolts per end unit.

Figure 6:
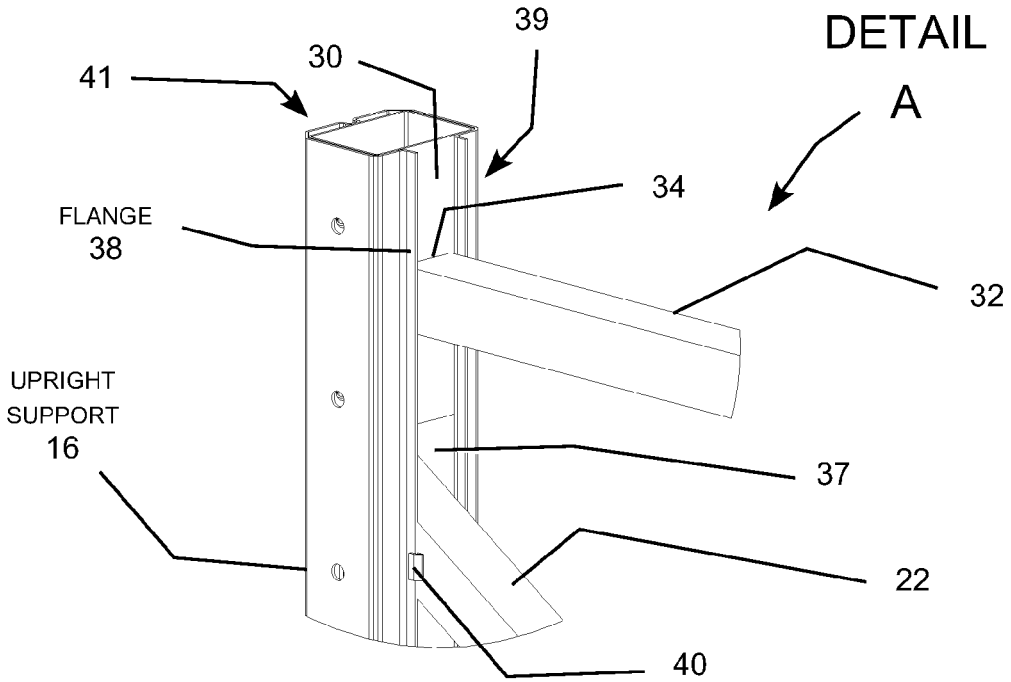
FIG. 6 is a perspective view of the upper crossbar and diagonal support detail of the demountable shelving unit.
Figure 7:
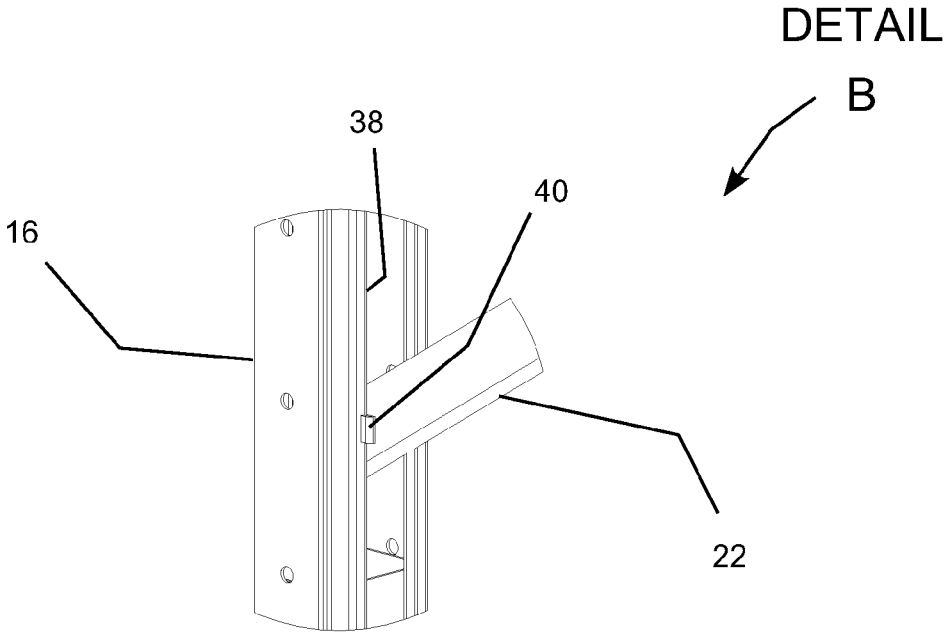
FIG. 7 is a perspective view of the lower diagonal support detail of the demountable shelving unit.

FIG. 6 shows the upper end detail (Detail A shown on FIG. 4) of the upright support 16. The upper crossbar 20 includes an upright insertion block 30 and a horizontal connector 32 that is preferably welded to the upright insertion block. The upright insertion block 30 is sized to be slidably received and captured within the upright support 16, while the horizontal connector 32 is sized to extend through a slot 37 defined by flanges 38 along the inner face 39 (inward facing side) of the upright support. The upright insertion block 30 is sized to slide freely within the channel defined by the interior of the upright support 16 while touching or nearly touching the portions of the interior of the insertion block designed to interface with the insertion block. Likewise, the horizontal connector 32 is sized slide freely within the slot 37 while touching or nearly touching the flanges 38. The diagonal support 22 is also sized slide freely within the slot 37 while touching or nearly touching the flanges 38 and also includes flange clips 40 that engage the flanges 38 when the diagonal support is installed in the upright support 16 as shown in FIG. 6. The flange clips 40 effectively restrain the flanges to the diagonal support to prevent the slot from widening under loading pressure. That is, the flange clips effectively pinch the flanges 38 to prevent the slot 37 from widening, which in turn prevents the upright support from buckling. FIG. 7 shows Detail B from FIG. 4, which is the lower connection between the diagonal support 22 and the upright support 16, which also includes flange clips 40 constraining the flanges 38 defining the slot 30, as described above, at another position along the upright support.

Figure 9:
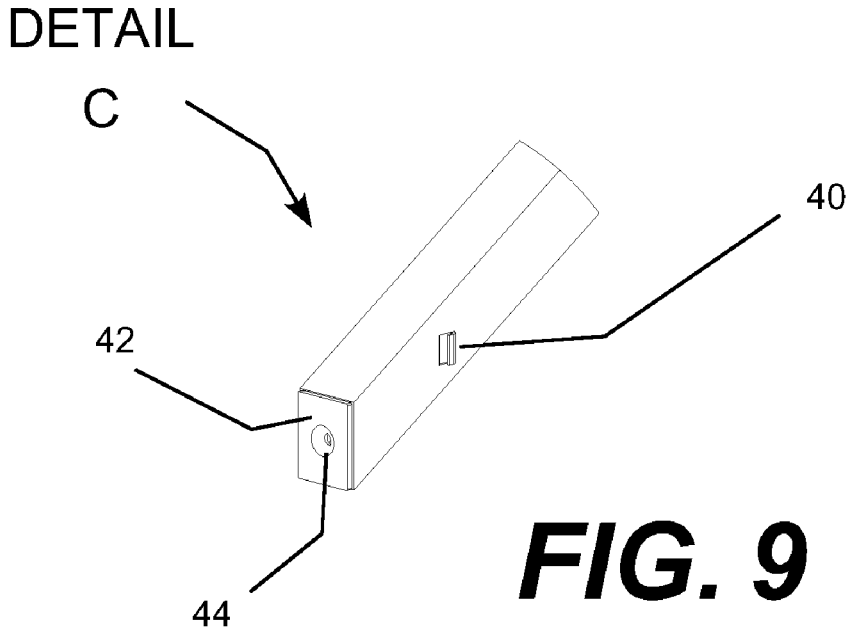
FIG. 9 is a perspective view of end detail for the diagonal support of the demountable shelving unit.
Figure 10:
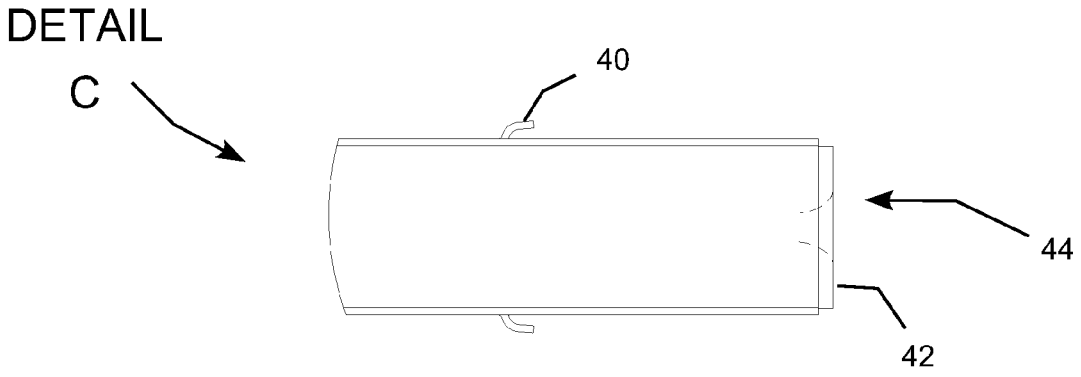
FIG. 10 is a side view of the end detail for the diagonal support of the demountable shelving unit.
Figure 11:
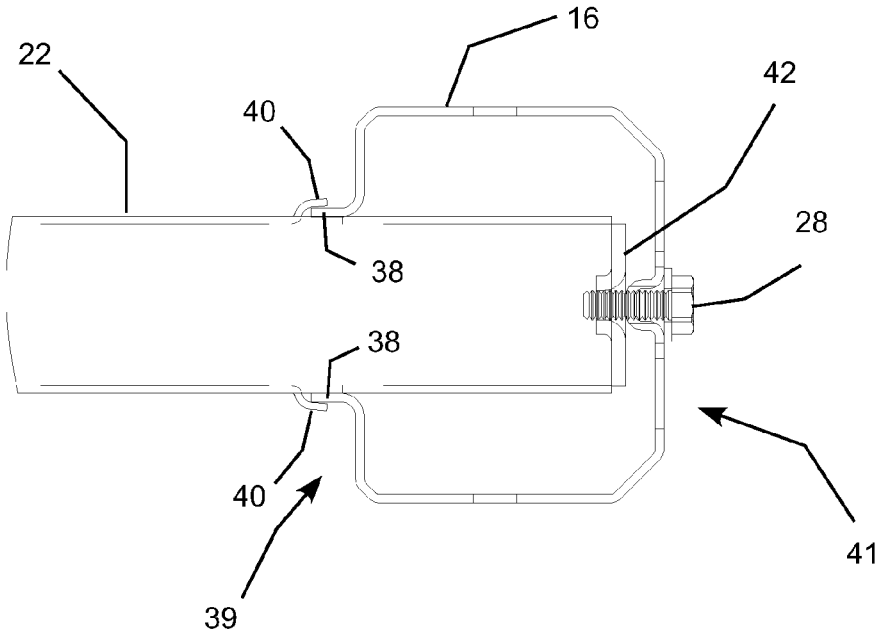
FIG. 11 is a top cross-section view of the end detail for the diagonal support of the demountable shelving unit.

FIG. 8 shows the diagonal support 22 and indicates the end detail (Detail C), which is shown in FIGS. 9 and 10. In addition, FIG. 11 shows a cross-section view of the diagonal support 22 as received within the upright support 16 and bolted into position. As shown in FIG. 9, the flange clip 40 is positioned on an angle with respect to the main axis of the diagonal support to conform to the diagonal mounting of the diagonal support with respect to the upright support. In addition, the end face 42 is similarly angled so that it aligned with the inside of the outward facing side (outer face 41 shown on FIG. 11) of the upright support 16. The end face 42 of the diagonal support 22 includes a screw hole 44 for receiving a the bolt 28 that attaches the diagonal support to the upright support in the position shown in FIG. 11 with the flange clip 40 engaging the flange 38. Of course, the flange clip 40 may be somewhat longer or shorter then shown in FIG. 9 as a matter of design choice. The end face 42 may be designed to be aligned with the outer face 41 and may lie flush with the outer face or be spaced slightly apart as a matter of design choice.

Figure 12:
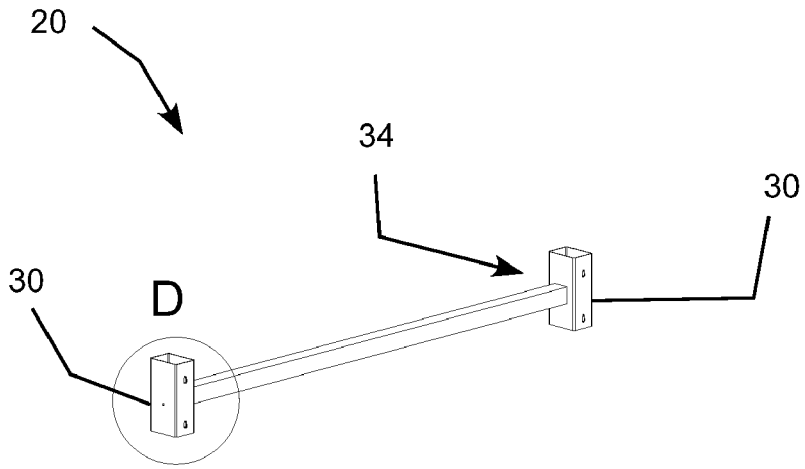
FIG. 12 is a perspective view of the upper crossbar of the demountable shelving unit.
Figure 13:
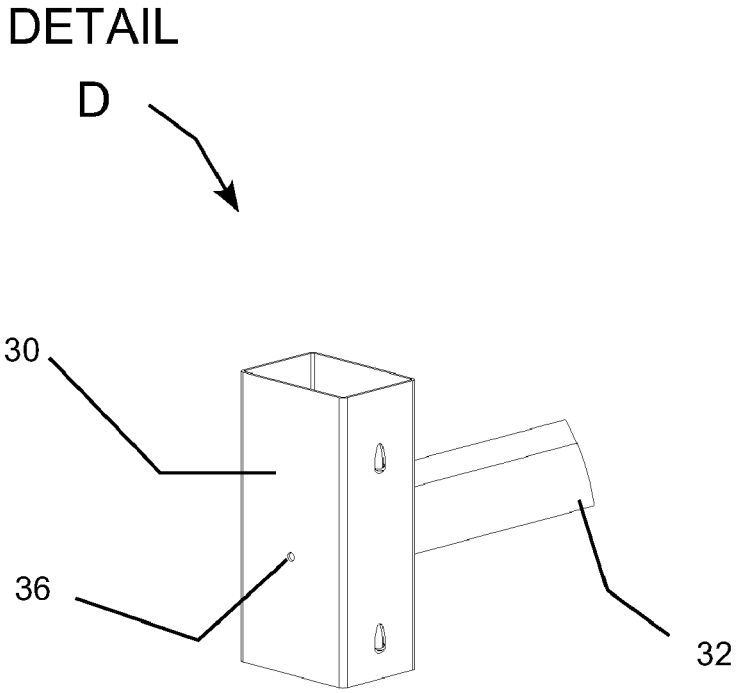
FIG. 13 is a perspective view of end detail for the upper crossbar of the demountable shelving unit.

FIG. 12 shows the upper crossbar 20 and indicates the end detail (Detail D), which is shown in FIG. 13. The upper crossbar 20 includes a pair of upright insertion blocks 30 and a horizontal connector 32 that is preferably welded to the upright insertion blocks. The rear face 35 of the upright insertion block 30 includes a screw hole 36 for bolting the insertion block to the upright support 16. The insertion block could include additional screw holes as a matter of design choice.

Figure 14:
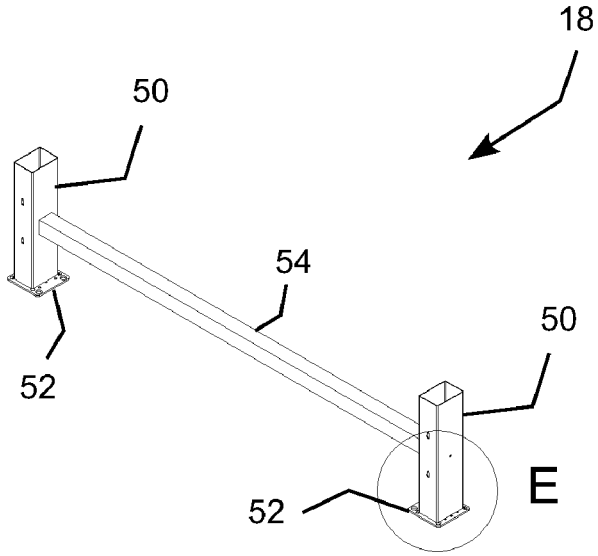
FIG. 14 is a perspective view of the lower crossbar of the demountable shelving unit.
Figure 15:
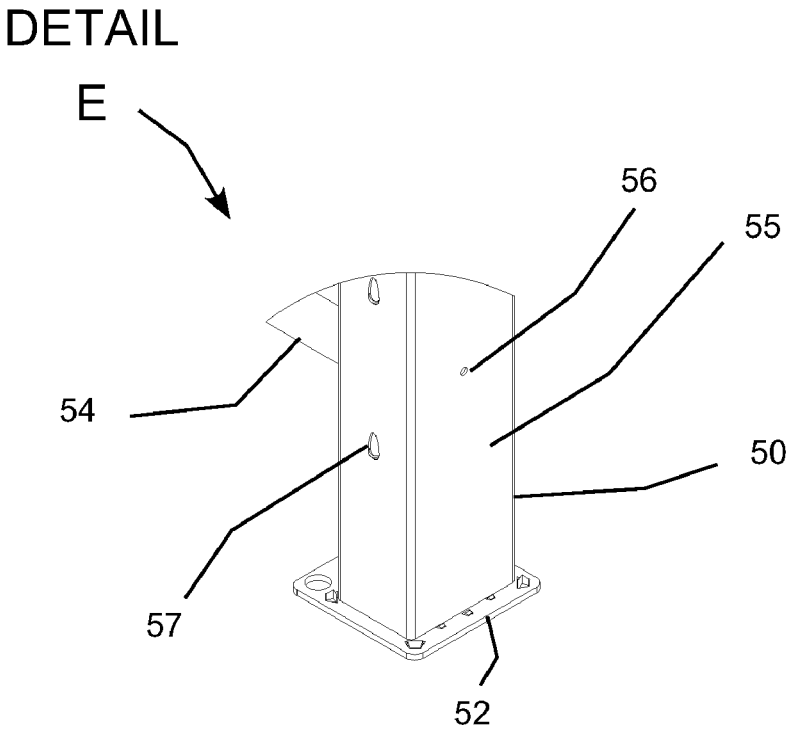
FIG. 15 is a perspective view of end detail for the lower crossbar of the demountable shelving unit.

FIG. 14 shows the lower crossbar 18 and indicates the end detail (Detail E), which is shown in FIG. 15. The lower crossbar 18 includes a pair of upright insertion blocks 50, each mounted to a base plate 52 that is preferably welded to its associated upright insertion block, and a horizontal connector 54 that is preferably welded to the upright insertion blocks. The rear face 55 of the upright insertion block 50 includes a screw hole 56 for bolting the insertion block to the upright support 16. The insertion block could include additional screw holes as a matter of design choice. The base plate includes a system of support tabs for securing the bottom end of the upright support, as shown in greater detail in FIGS. 20-25. The insertion block 50 also may includes one or more side holes 57 for receiving additional bolts for securing the upright support 16 to the upright insertion block, if desired.

Figure 16:
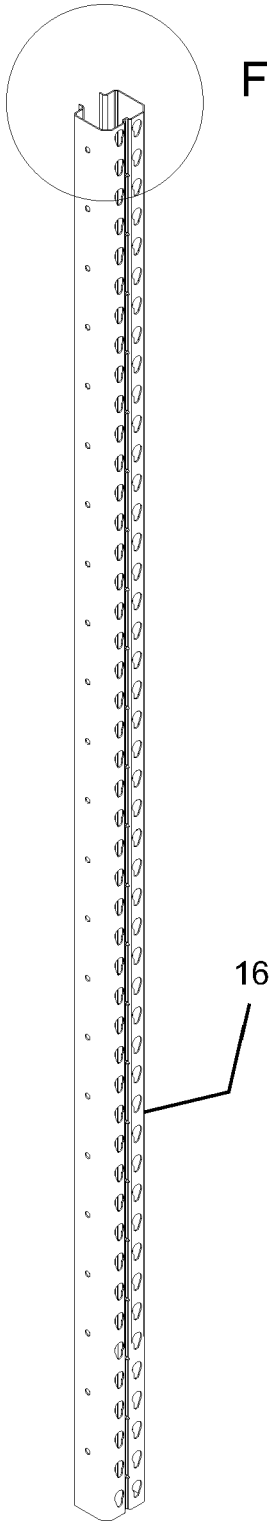
FIG. 16 is a perspective view of the upright support of the demountable shelving unit.
Figure 17:
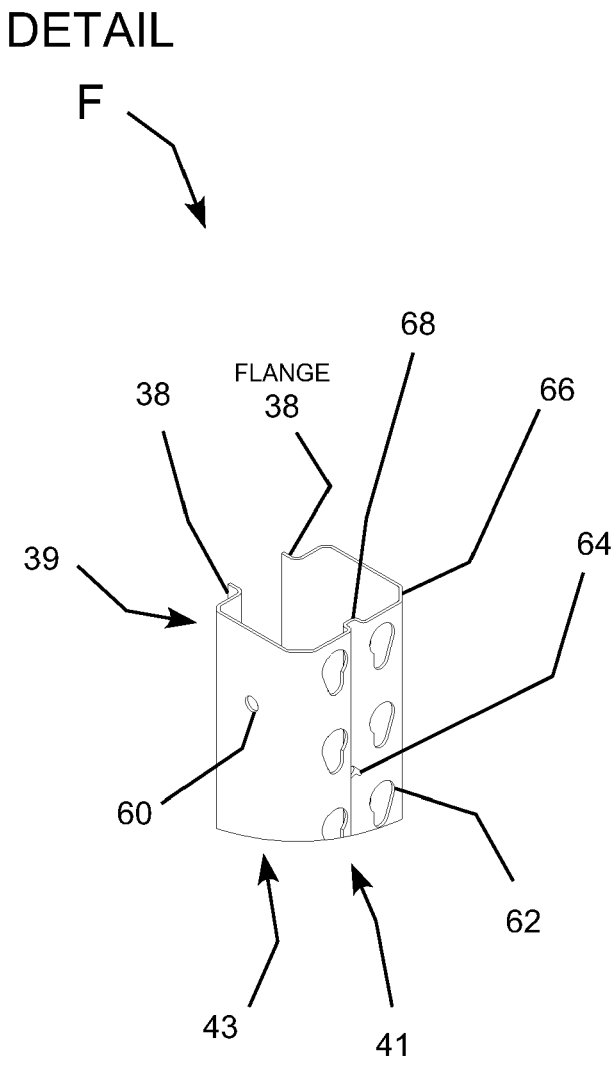
FIG. 17 is a perspective view of end detail for the upright support of the demountable shelving unit.
Figure 18:
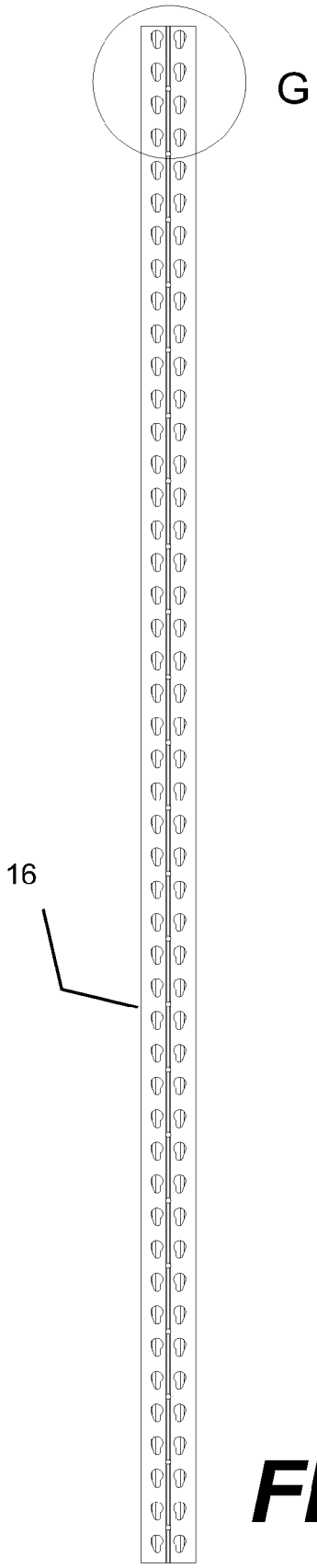
FIG. 18 is a side view of the upright support of the demountable shelving unit.
Figure 19:
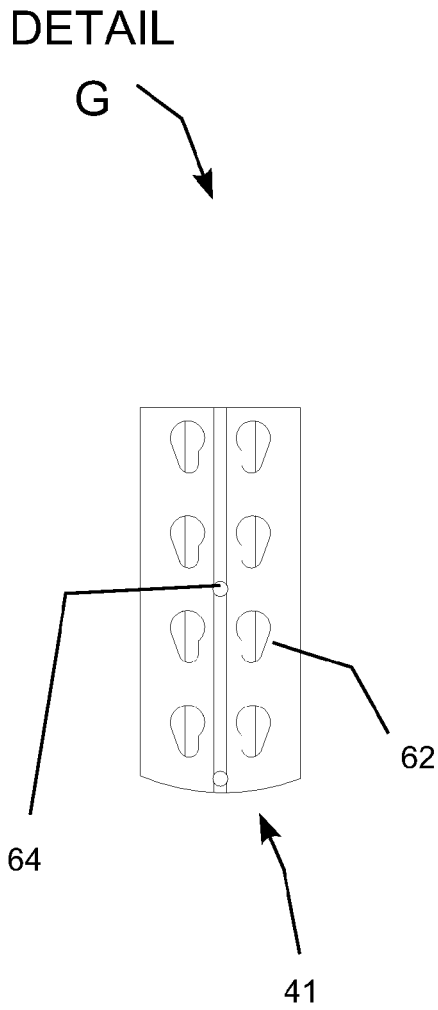
FIG. 19 is a side detail view for the upright support of the demountable shelving unit.
Figure 20:
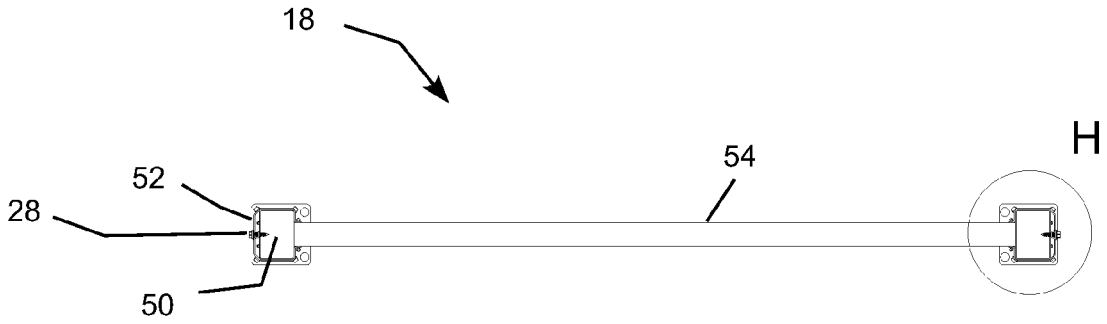
FIG. 20 is a top cross-section view of the lower crossbar of the demountable shelving unit.
Figure 21:
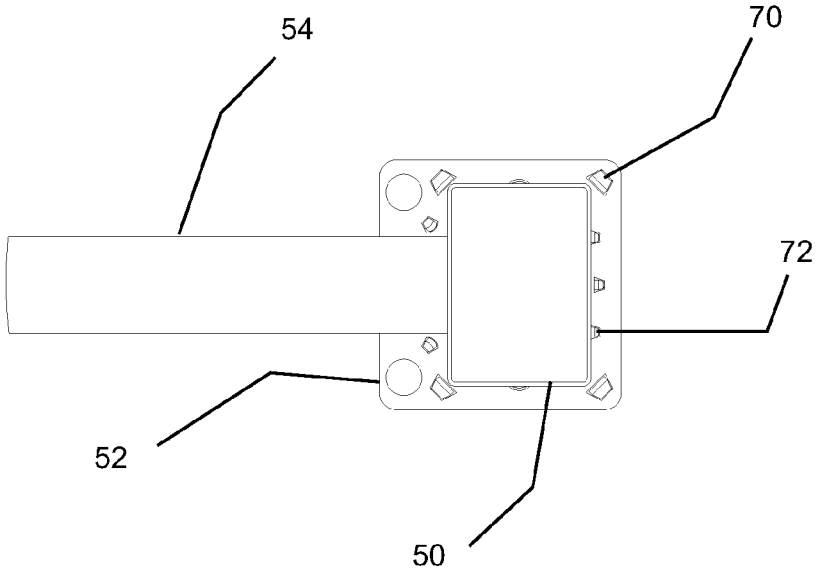
FIG. 21 is a top cross-section view of end detail for the lower crossbar of the demountable shelving unit without an upright support.
Figure 22:
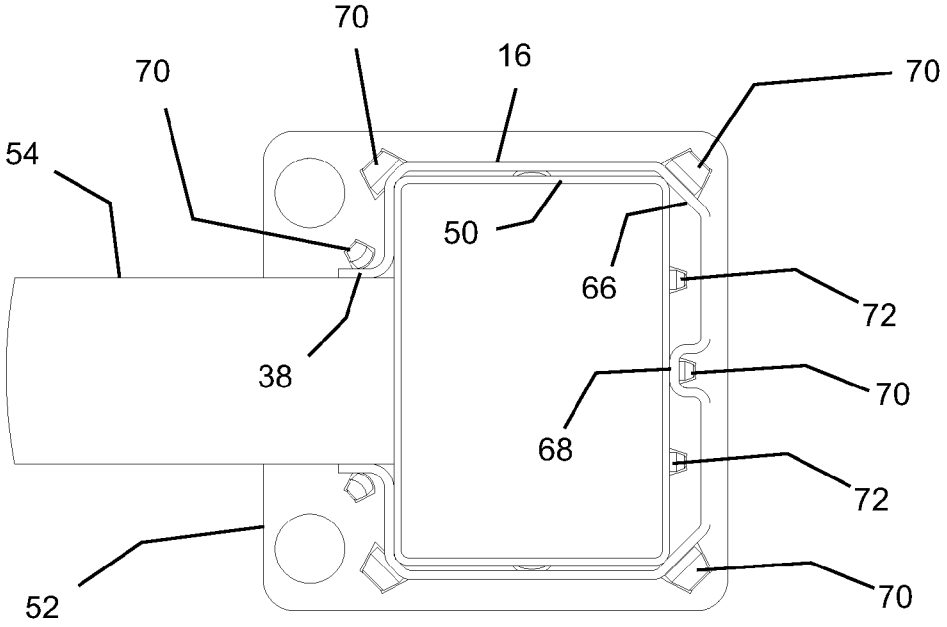
FIG. 22 is a top cross-section view of end detail for the lower crossbar of the demountable shelving unit with an upright support.
Figure 23:
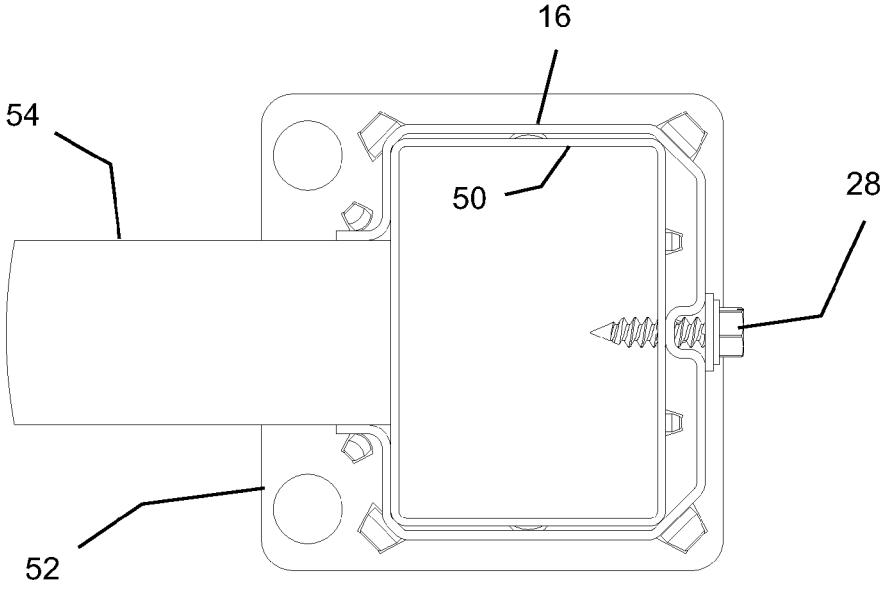
FIG. 23 is a top cross-section view of end detail for the lower crossbar of the demountable shelving unit with an upright support and a bolt.

FIG. 16 shows a perspective view of the upright support 16 and indicates the end detail (Detail F), which is shown in FIG. 17. FIG. 18 shows a side view of the upright support 16 and indicates the end detail (Detail G), which is shown in FIG. 19. The upright support has an open channel design defining the slot 37 between the flanges 38. The upright support is typically formed by bending sheet metal stock into the shape shown, which includes two slightly spaced apart bends in each corner bend 66 and a central channel 68 formed by four bends. These additional bends add strength to the upright support. A series of teardrop sockets 62 extend along the outer face 41 of the upright support and a series of screw holes 64 extend along the central channel 68. Another series of screw holes 60 extend along the side face 43 of the upright support. At least some of the screw holes 62 are positioned to secure the diagonal supports and upright insertion blocks to the upright support, while the screw holes 60 may be used to attach adjacent end units to each other and/or to attach other items, such as hangers, to the shelving unit.

Figure 28:
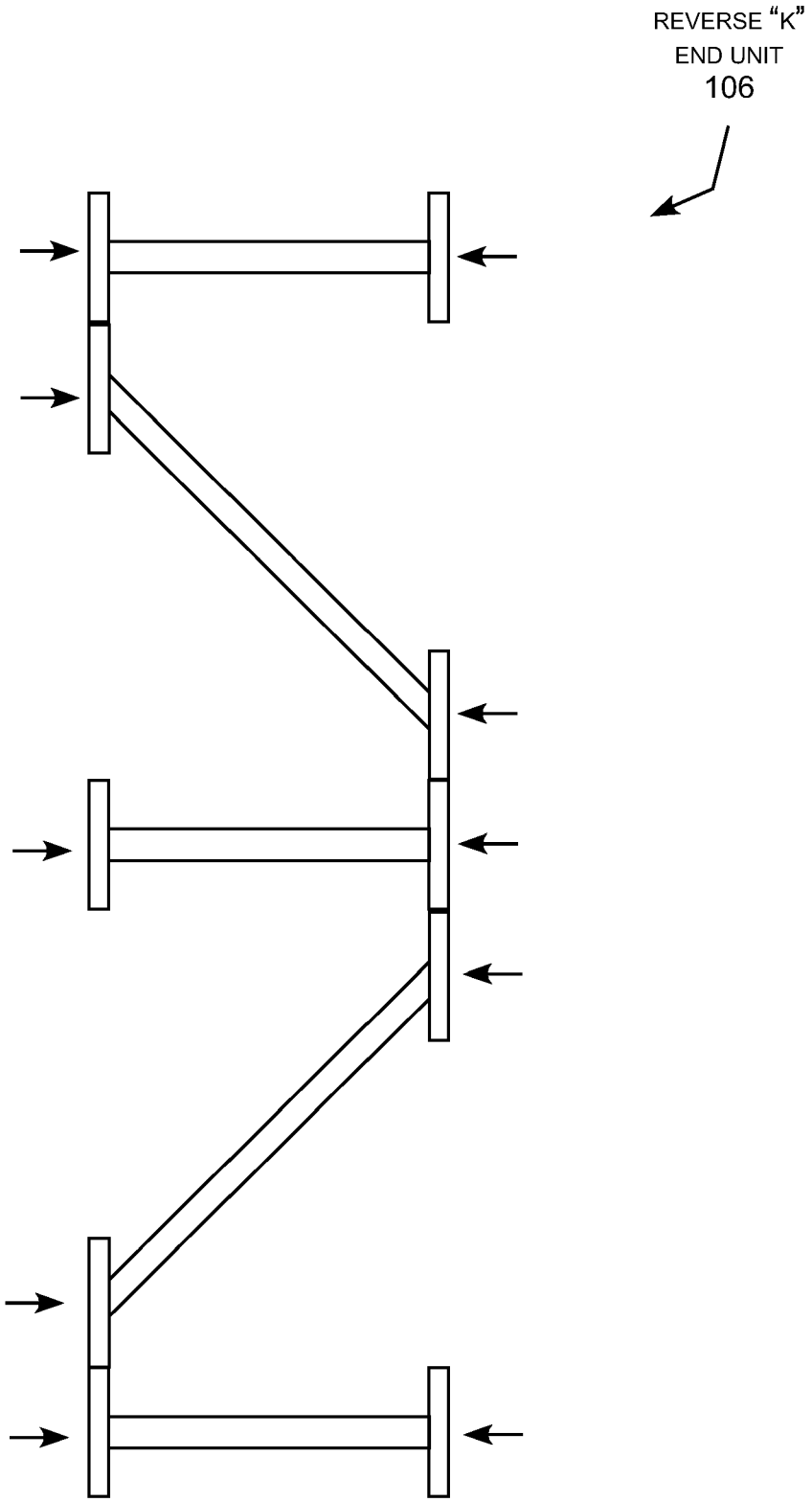
FIG. 28 is a conceptual illustration of the connectors extending between the upright supports for a reverse "K" end unit.

FIGS. 20-25 show the connection between the bottom end of the upright support 16 and the lower crossbar 18 in greater detail. The bottom end of the upright support is received over the upright support 50 and rests against the base plate 52 under the weight of the shelving unit. A system of support tabs including corner braces 70 preferably formed by die cuts and bends in the base plate secure the outside of the bottom end of the upright support, while the upright insertion block secures the inside of the bottom end of the upright support. That is, the bottom end of the upright support lies against the base plate in between the support tabs and the upright insertion block 50. The fit here should be as snug interference fit. As shown in FIG. 28, a bolt 28 secures the bottom of the upright support to the upright insertion block 50.

Figure 24:
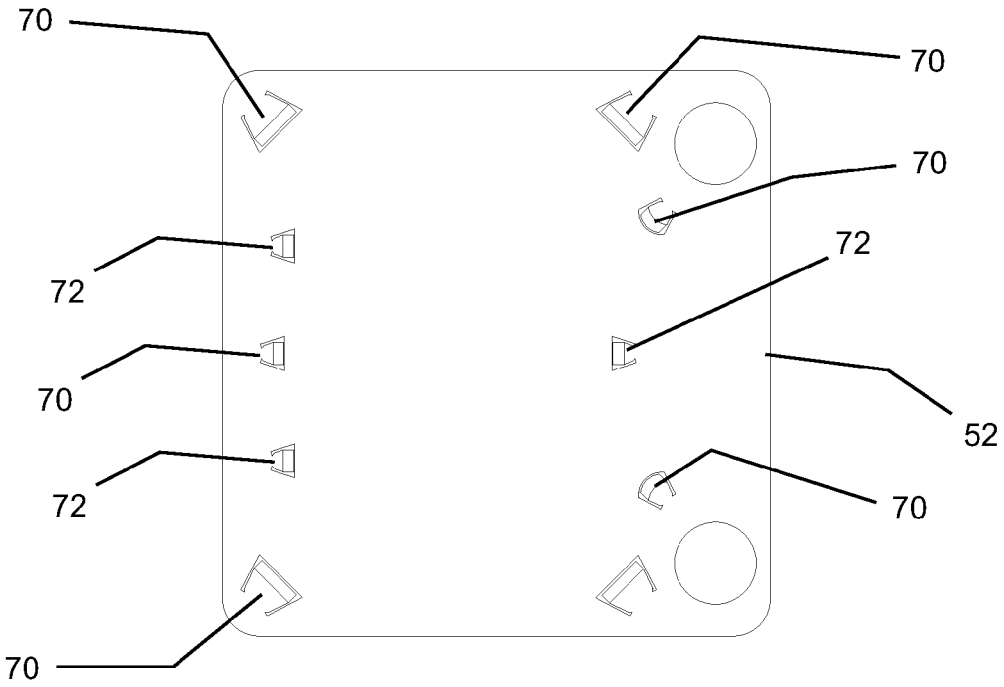
FIG. 24 is a top view of the base plate of the demountable shelving unit.
Figure 25:
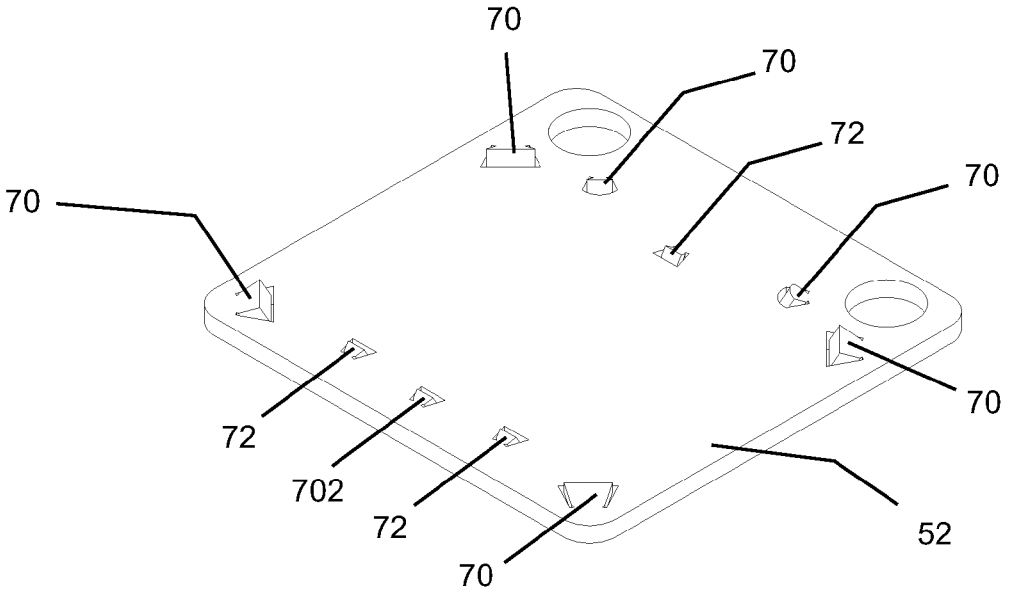
FIG. 25 is a perspective view of the base plate of the demountable shelving unit.

The base plate 52 may be welded to the upright insertion block 50. As an alternative, the base plate may be separate from the insertion block as shown in FIGS. 24 and 25. In this embodiment, the base plate 52 includes a set of corner and side braces 70 for holding the upright support in place and a set of side braces 72 for holding the upright insertion block in place. In this configuration, a standard crossbar serves as the lower crossbar 18 and the upper crossbar 20 and a separate base plate is attached to the standard crossbar to form the lower crossbar. As a result, this configuration needs only a single set of standard crossbars, which stack more compactly without base plates welded to the lower crossbars. It should also be appreciated that one or more of the side braces 72 securing the insertion block 50 to the base plate could form a substantially vertical tab with a screw hole corresponding to a screw hole in the insertion block allowing the base plate to be bolted to the insertion block of the lower crossbar during assembly.

Figure 26A:
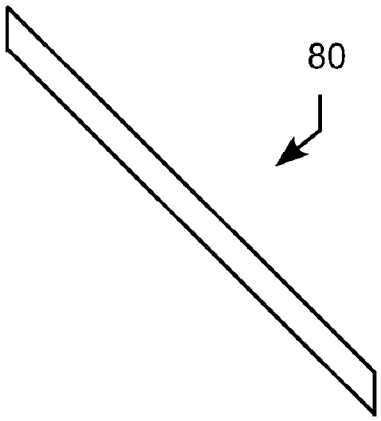
FIGS. 26A-D show alternative configurations for the diagonal support.
Figure 26B:
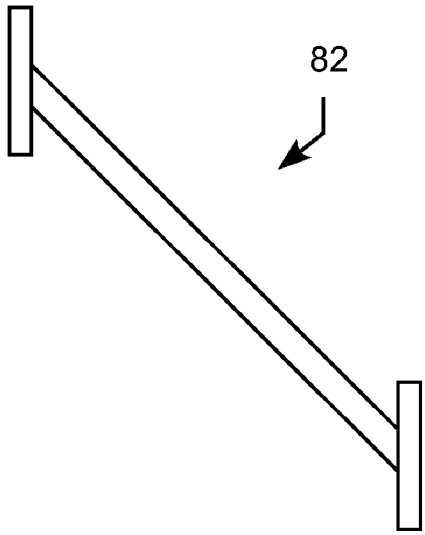
Figure 26C:
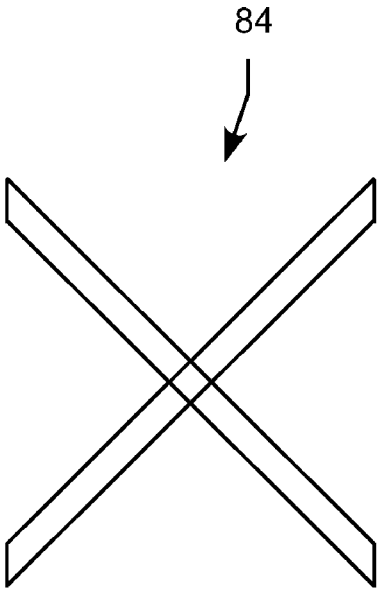
Figure 26D:
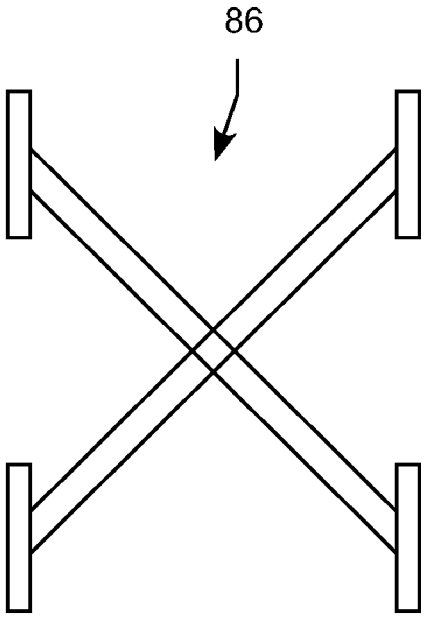

FIGS. 26A-D show alternative configurations for the diagonal support, which are preferably welded together and include flange tabs (omitted in these figures) as described previously. FIG. 26A shows a single-bar diagonal support 80 without upright insertion blocks, which attaches to a pair of upright supports with two bolts. FIG. 26B shows a single-bar diagonal support 82 with upright support blocks, which typically attaches to a pair of upright supports with one or two bolts per insertion block for a total of two or four bolts per diagonal support. FIG. 26C shows a dual-bar diagonal support 84 without upright insertion blocks, which attaches to a pair of upright supports with four bolts. FIG. 26D shows a dual-bar diagonal support 86 with upright insertion blocks, which typically attaches to a pair of upright supports with one or two four bolts per insertion block for a total of four bolts or eight bolts per diagonal support.

Figure 27:
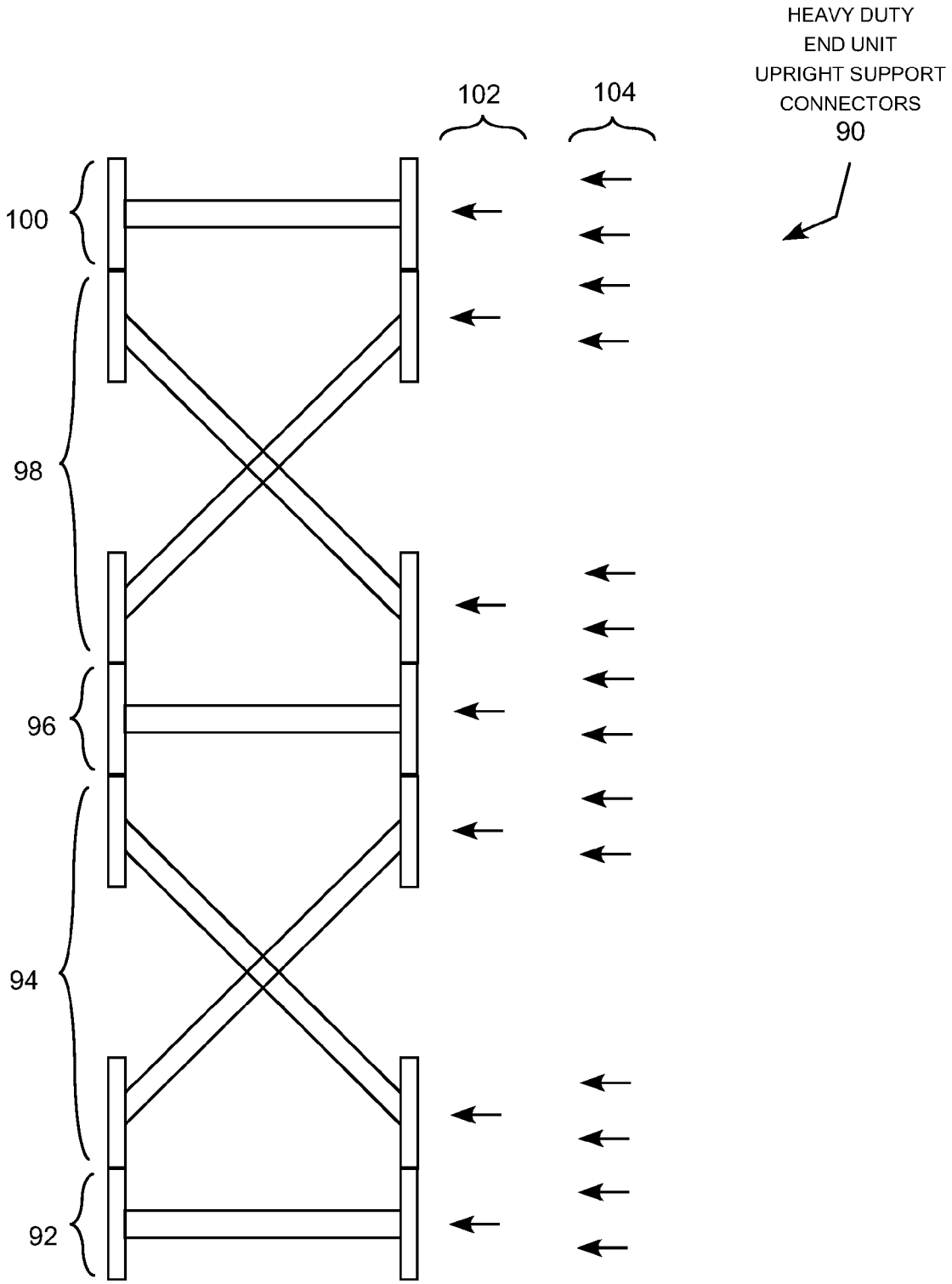
FIG. 27 is a conceptual illustration of the connectors extending between the upright supports for an end unit in a heavy duty demountable shelving unit.

FIG. 27 shows a conceptual illustration (not shown to scale) of the connectors 90 including crossbars and diagonal supports that extend between a pair of upright supports in an end unit in a heavy duty demountable shelving unit. This unit includes a lower crossbar 92, a lower dual-bad diagonal support 92 with insertion blocks, a central crossbar 94, and upper dual-bar diagonal support 98 with insertion blocks, and an upper crossbar 100 stacked on top of each other. Each side of each component may be attached to its corresponding upright support with a single bolt as shown in the bolt locations 102 or with a pair of bolts as shown in blot locations 104. This configuration is suitable for an eight foot tall unit and the diagonal supports may be expanded to construct a sixteen foot tall unit. In general, the components shown may be expanded or contracted, and sections may be added or deleted, to create heavy duty shelving units having the desired height and load carrying capacity characteristics.

Figure 29:
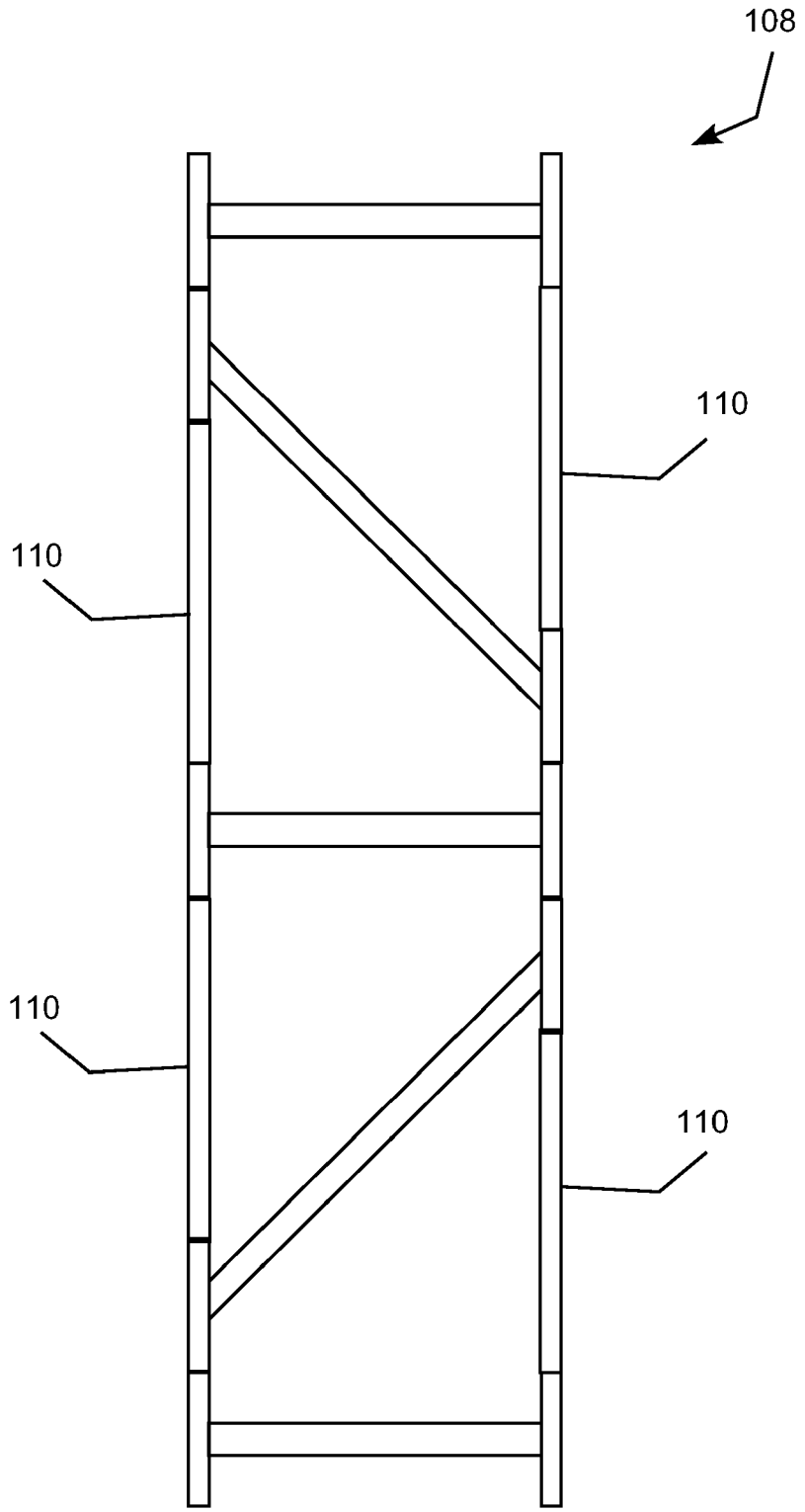
FIG. 29 is a conceptual illustration of the connectors extending between the upright supports for a reverse "K" end unit with column stiffeners.
Figure 30A:
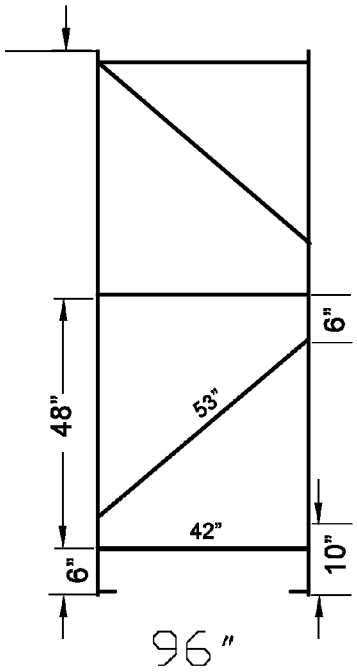
FIGS. 30A-H show conceptual illustrations of reverse "K" end units of various heights.
Figure 30B:
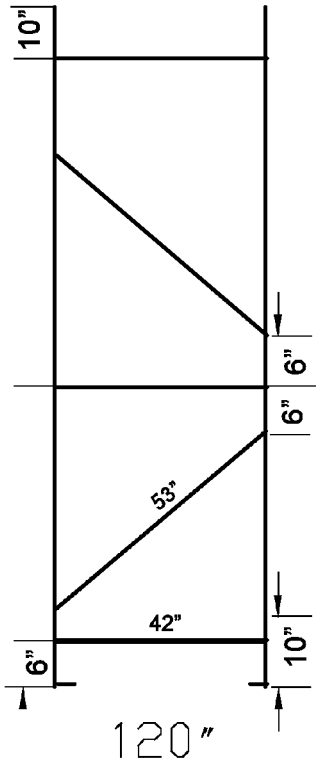
Figure 30C:
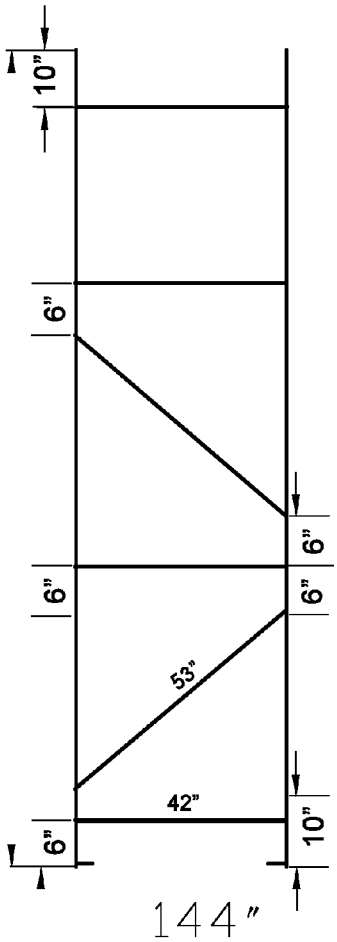
Figure 30D:
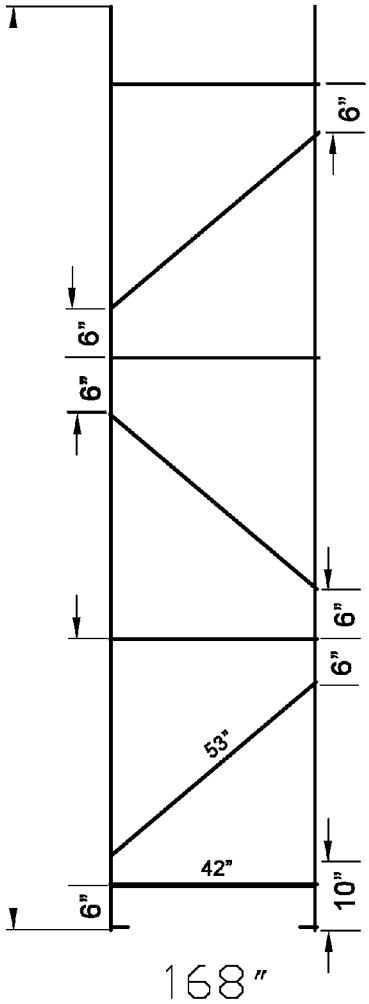
Figure 30E:
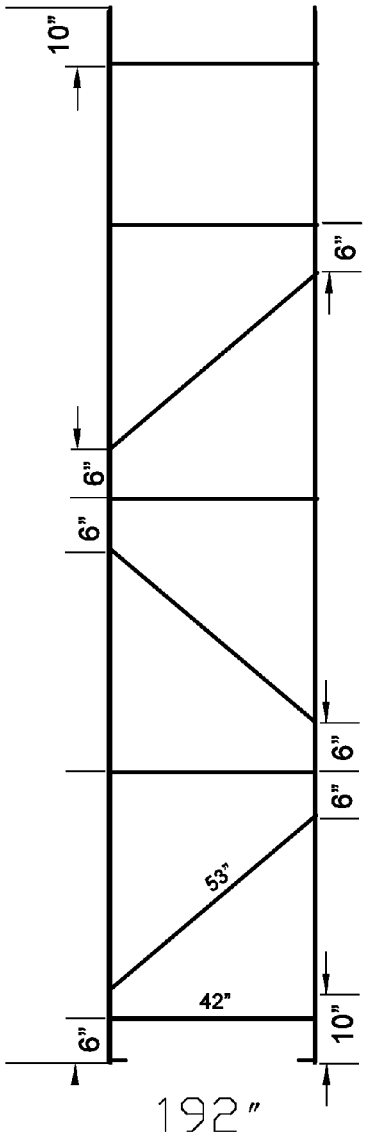
Figure 30F:
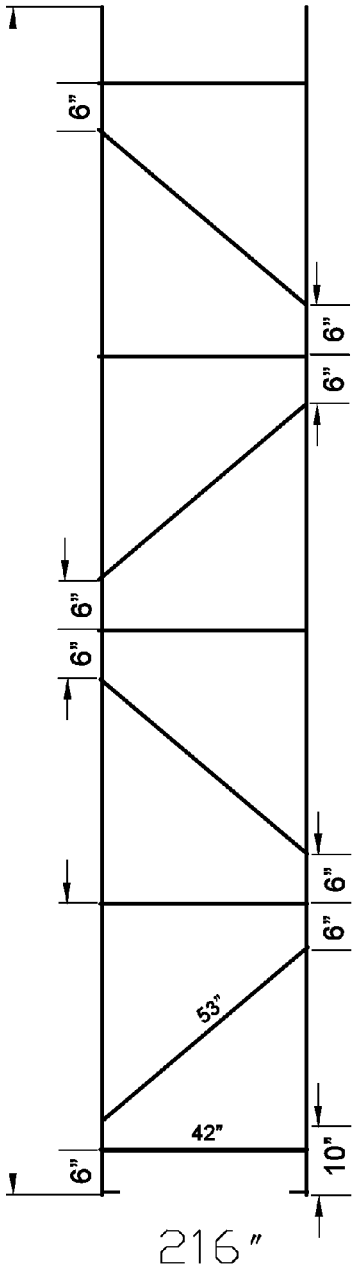
Figure 30G:
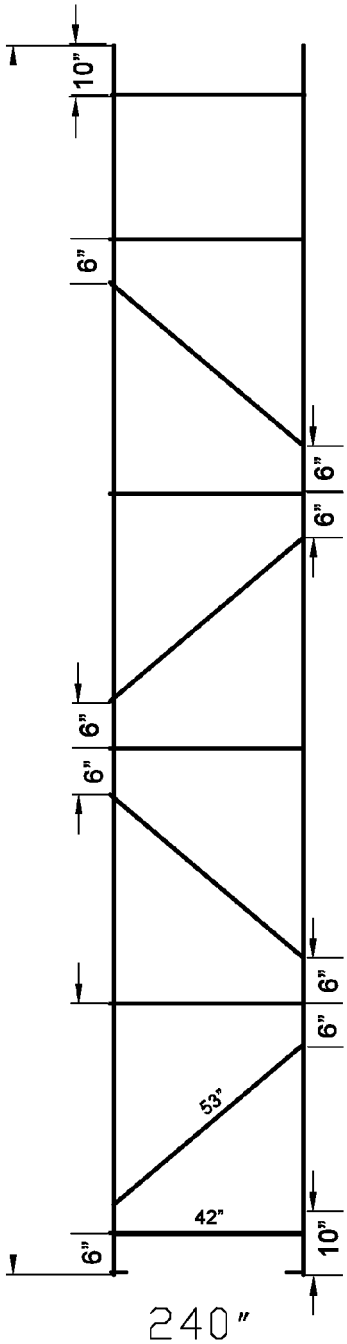
Figure 30H:
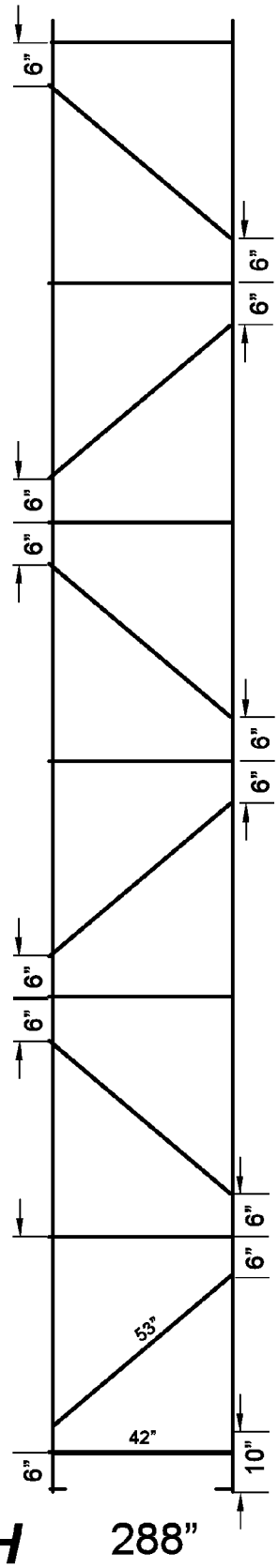

FIG. 28 is a conceptual illustration of the connectors including crossbars and diagonal supports extending between the upright supports for a reverse "K" end unit 106, which is a preferred configuration for many heavy duty applications. FIG. 29 is a conceptual illustration of the reverse "K" end unit 106 with column stiffeners 110. Any of the embodiments of the demountable shelving unit may include column stiffeners, typically tubes similar to upright insertion block extending between insertion blocks to fill the space between insertion blocks on the interior of the upright support. In this manner, the insertion blocks and column stiffeners form a continuous segmented beam inside the upright support. The column stiffener may also include bolt holes for bolting the upright support to the column stiffener at various locations along the upright support, if desired, for example along the side faces 43 (see FIG. 17) of the upright support 16. In addition, FIGS. 30A-H show conceptual illustrations of reverse "K" end units of various heights with typical dimensions shown on the figures. Of course, other alternative configurations may be designed using various combinations of the elements and design techniques described in the preceding specification.

It should be understood that the foregoing relates only to the exemplary embodiments of the present invention, and that numerous changes may be made therein without departing from the spirit and scope of the invention as defined by the following claims.

The invention claimed is:

1. A demountable shelving unit, comprising:

first and second planar, vertically oriented end units and a plurality of planar, horizontally oriented shelf units removably connected between and orthogonal to the end units;

each end unit comprising front and rear open-channel upright supports and upper and lower crossbars slidably received within the upright supports;

each open-channel upright support having an undivided outer face and an opposing divided inner face defining a slot comprising by first and second flanges on opposing sides of the slot extending substantially perpendicular to and away from the outer and inner faces;

each cross bar comprising front and rear upright insertion blocks and a horizontal connector;

for each end unit, the front upright insertion block is slidably captured within the front upright support, the rear upright insertion block is slidably captured within the rear upright support, and the horizontal connector extends through the slots of the front and rear uprights supports;

wherein each end unit further comprises:

at least one diagonal support extending diagonally between the front and rear upright supports and through the slots of the front and rear upright supports;

the diagonal support comprising a front end face angled to be aligned with the outer face of the front upright support and a rear end face angled to be aligned with the outer face of the rear upright support;

a first threaded fastener extending through the outer face of the front upright support and through the front end face of the diagonal support securing the diagonal support to the front upright support;

a second threaded fastener extending through the outer face of the rear upright support and through the rear end face of the diagonal support securing the diagonal support to the rear upright support; and wherein for each upright support:

the diagonal support comprises a first flange clip engaging the first flange to secure the first flange between the diagonal support and the first flange clip; and the diagonal support comprises a second flange clip engaging the second flange to secure the second flange between the diagonal support and the second flange clip.

2. The demountable shelving unit of claim 1, wherein for each end unit and for each upright support, the upright support defines a top end and a bottom end, and wherein for each upright insertion block of each lower crossbar:

the upright insertion block is terminated by a base plate comprising a plurality of support tabs extending from the base plate; and the bottom end of the upright support is positioned between the upright insertion block and the support tabs extending from the base plate.

3. The demountable shelving unit of claim 2, further comprising for each base plate:

a threaded fastener extending through the upright support and through the upright insertion block above the base plate securing the upright support to the upright insertion block with the bottom end of the upright support is positioned between the upright insertion block and the support tabs extending from the base plate.

4. The demountable shelving unit of claim 3, wherein each base plate is welded to its associated upright insertion block.

5. The demountable shelving unit of claim 1, wherein each upright insertion blocks is welded to an associated crossbar.

6. The demountable shelving unit of claim 1, wherein for each upright support and each upright insertion block of each upper crossbar:

the upright support comprises a fastener hole;

the upright insertion block comprises a fastener hole corresponding to the fastener hole of the upright support; and a threaded fastener extends through the fastener hole of the upright support and through the fastener hole of the upright insertion block to secure the upper crossbar to the upright support.

7. The demountable shelving unit of claim 1, wherein:

each upright support comprises a plurality of tear-drop shaped sockets; and each horizontal shelf unit comprises a plurality of rivet-type connectors configured for quick disconnect engagement with the tear-drop shaped sockets.

8. The demountable shelving unit of claim 7, wherein each upright support comprises a plurality of spaced apart fastener holes for securing the upper crossbar to the upright support at different locations along the upright support.

9. The demountable shelving unit of claim 8, wherein:

each end unit consists essentially of a front upright support, a rear upright support, an upper crossbar, a lower cross bar, at least one diagonal support; and each end unit is configured to be assembled with a plurality of threaded fasteners.

10. The demountable shelving unit of claim 1, wherein:

each end unit consists essentially of a front upright support, a rear upright support, an upper crossbar, a lower cross bar, an upper diagonal support, and a lower diagonal support; and each end unit is configured to be assembled with a plurality of threaded fasteners.

11. The demountable shelving unit of claim 10, wherein each end unit is configured to be assembled with no more than eight threaded fasteners.

12. A demountable shelving unit, comprising:

first and second planar, vertically oriented end units and a plurality of planar, horizontally oriented shelf units removably connected between and orthogonal to the end units;

each end unit comprising front and rear open-channel upright supports and upper and lower crossbars slidably received within the upright supports;

each open-channel upright support having an undivided outer face and an opposing divided inner face defining a slot comprising by first and second flanges on opposing sides of the slot extending substantially perpendicular to and away from the outer and inner faces;

each cross bar comprising front and rear upright insertion blocks and a horizontal connector;

for each end unit, the front upright insertion block is slidably captured within the front upright support, the rear upright insertion block is slidably captured within the rear upright support, and the horizontal connector extends through the slots of the front and rear uprights supports; and wherein for each end unit and for each upright support, the upright support defines a top end and a bottom end, and wherein for each upright insertion block of each lower crossbar:

the upright insertion block is terminated by a base plate welded to the insertion block comprising a plurality of support tabs extending from the base plate, the bottom end of the upright support is positioned between the upright insertion block and the support tabs extending from the base plate, a threaded fastener extends through the upright support and through the upright insertion block above the base plate securing the upright support to the upright insertion block with the bottom end of the upright support is positioned between the upright insertion block and the support tabs extending from the base plate;

wherein each end unit further comprises:

at least one diagonal support extending diagonally between the front and rear upright supports and through the slots of the front and rear upright supports;

the diagonal support comprising a front end face angled to be aligned with the outer face of the front upright support and a rear end face angled to be aligned with the outer face of the rear upright support;

a first threaded fastener extending through the outer face of the front upright support and through the front end face of the diagonal support securing the diagonal support to the front upright support;

a second threaded fastener extending through the outer face of the rear upright support and through the rear end face of the diagonal support securing the diagonal support to the rear upright support; and wherein for each upright support:

the diagonal support comprises a first flange clip engaging the first flange to secure the first flange between the diagonal support and the first flange clip; and the diagonal support comprises a second flange clip engaging the second flange to secure the second flange between the diagonal support and the second flange clip.

13. The demountable shelving unit of claim 12, wherein each upright insertion blocks is welded to an associated crossbar.

14. The demountable shelving unit of claim 12, wherein for each upright support and each upright insertion block of each upper crossbar:

the upright support comprises an upper fastener hole;

the upright insertion block comprises a fastener hole corresponding to the upper fastener hole of the upright support; and a threaded fastener extends through the upper fastener hole of the upright support and through the fastener hole of the upright insertion block to secure the upper crossbar to the upright support.

15. The demountable shelving unit of claim 14, wherein:

each upright support comprises a plurality of tear-drop shaped sockets; and each horizontal shelf unit comprises a plurality of rivet-type connectors configured for quick disconnect engagement with the tear-drop shaped sockets.

16. The demountable shelving unit of claim 15, wherein:

each end unit consists essentially of a front upright support, a rear upright support, an upper crossbar, a lower cross bar, at least one diagonal support; and each end unit is configured to be assembled with a plurality of threaded fasteners.

17. The demountable shelving unit of claim 16, wherein:

each end unit comprising a front upright support, a rear upright support, an upper crossbar, a lower cross bar, an upper diagonal support, and a lower diagonal support; and each end unit is configured to be assembled with a plurality of threaded fasteners.

18. The demountable shelving unit of claim 17, wherein each end unit is configured to be assembled no more than eight threaded fasteners.

* * * * *